US008661576B2

(12) United States Patent
Ludlow et al.

(10) Patent No.: US 8,661,576 B2
(45) **Date of Patent: *Mar. 4, 2014**

(54) SPAS AND BATHING SYSTEMS WITH UPGRADEABLE AND INTERCHANGEABLE JET STATIONS

(76) Inventors: David J. Ludlow, Salt Lake City, UT (US); Alan L. Robins, Pleasant Grove, UT (US); Trent L. Taylor, Orem, UT (US); Derrick P. Christman, West Jordan, UT (US); Michael J. Adams, West Jordan, UT (US); Stephen M. Fleischer, Orem, UT (US); Richard Alex Eddington, South Jordan, UT (US); Marvin H. Howell, Salt Lake City, UT (US)

( * ) Notice: Subject to any disclaimer, the term of this patent is extended or adjusted under 35 U.S.C. 154(b) by 9 days.

This patent is subject to a terminal disclaimer.

(21) Appl. No.: 13/053,167

(22) Filed: Mar. 21, 2011

(65) Prior Publication Data

US 2011/0225720 A1 Sep. 22, 2011

Related U.S. Application Data

(63) Continuation-in-part of application No. 11/738,911, filed on Apr. 23, 2007, now Pat. No. 7,908,684, which is a continuation of application No. PCT/US2004/034714, filed on Oct. 21, 2004.

(51) Int. Cl.
*A47K 3/00* (2006.01)

(52) U.S. Cl.
USPC ..... 4/541.1

(58) Field of Classification Search
USPC ..... 4/541.1, 538, 541.6, 665, 613; 192/58.62; 417/223, 319
See application file for complete search history.

(56) References Cited

U.S. PATENT DOCUMENTS

| | | | | | |
|---|---|---|---|---|---|
| 3,067,435 | A | * | 12/1962 | Nash | 4/492 |
| 3,677,474 | A | * | 7/1972 | Lorenzen | 239/587.4 |
| 5,754,989 | A | * | 5/1998 | Ludlow | 4/541.6 |
| 5,987,663 | A | * | 11/1999 | Ludlow et al. | 4/541.1 |
| 6,000,073 | A | * | 12/1999 | Eddington | 4/541.1 |
| 6,092,246 | A | * | 7/2000 | Ludlow | 4/541.6 |
| 6,141,804 | A | | 11/2000 | Pinciaro | |
| 6,256,805 | B1 | * | 7/2001 | Ludlow et al. | 4/541.1 |
| 6,543,067 | B2 | * | 4/2003 | Eddington et al. | 4/541.1 |
| 6,745,413 | B2 | * | 6/2004 | Pinciaro | 4/541.6 |
| 7,908,684 | B2 | * | 3/2011 | Ludlow | 4/584 |
| 2004/0025249 | A1 | | 2/2004 | Berry | |
| 2006/0101573 | A1 | | 5/2006 | Hallam | |

* cited by examiner

*Primary Examiner* — Lori Baker
(74) *Attorney, Agent, or Firm* — Amy Fiene; James Sonntag

(57) ABSTRACT

A bathing system with a molded shell has hollows in the shell. A canister installed in each hollow with jets mounted upon the front jet plate of the canister. The canister is of simple construction that is mounted in a hollow and is removable and interchangeable for easy upgrading and repair of the bathing system.

12 Claims, 31 Drawing Sheets

SPAS AND BATHING SYSTEMS WITH UPGRADEABLE AND INTERCHANGEABLE JET STATIONS

CROSS REFERENCE TO RELATED APPLICATIONS

This application is a continuation-in-part of U.S. patent application Ser. No. 11/738,911, filed Apr. 23, 2007, now U.S. Pat. No. 7,908,684 which is a continuation of International Application filed under the Patent Cooperation Treaty Number PCT/US2004/034714, filed Oct. 21, 2004, both of which are incorporated by reference.

FEDERAL RESEARCH STATEMENT (Not applicable)

BACKGROUND OF INVENTION

An advance in the construction of spas has been the development of modular construction systems that allow for easier upgrading and repair of water jet systems in a spa. These modular systems are disclosed in U.S. Pat. No. 5,754,989, issued 26 May 1998, titled "PLUMBING AND SHELL SYSTEM FOR SPA"; U.S. Pat. No. 6,092,246, issued 25 Jul. 2000, titled "PLUMBING AND SHELL SYSTEM FOR SPA"; U.S. Pat. No. 6,000,073, issued 14 Dec. 1999, titled "JET ZONE DISTRIBUTION SYSTEM FOR SPAS"; U.S. Pat. No. 5,987,663, issued 23 Nov. 1999, "MODULAR SYSTEM FOR SPAS AND BATHING SYSTEMS"; U.S. Pat. No. 6,256,805, issued 1 Jul. 2001, titled "MODULAR SYSTEM FOR SPAS AND BATHING SYSTEMS"; and U.S. Pat. No. 6,543,067, issued 8 Apr. 2003, titled "INTEGRATED MANIFOLD SYSTEM FOR SPAS". These patents provide background, and are hereby incorporated by reference.

In these modular systems a shell is constructed with depressions or hollows in the shell wall. Each of the hollows is fitted with a modular unit, here referred to as a modular unit (also called JetPak™). The modular unit comprises a cover for the hollow upon which are mounted jets for injecting water into the spa containment. A water inlet line extends through the shell to provide a water supply for the jets. To remove the jets (for replacement, repair, or for an upgrade to different jets), the water supply lines for the jets are disconnected from the water supply and the cover is removed. To allow disconnecting of the water inlet line from the modular unit, a manifold is provided that has unions for disconnection and reconnection to the water inlet line. The manifold also has ports for water supply lines to multiple jets, and an air supply manifold with ports for air supply lines to the jets.

The water supply system of the spa comprises one or more water inlet lines with multiple modular units connected through their respective manifolds in series along a water supply line. The supply line usually enters the hollow above the water line, which eases access to the manifold. The water inlet line enters the hollow and is connected to the manifold through the union. A water exit is usually provided through a union connection to the manifold and a water line that becomes the water inlet line for the next modular unit in the water supply circuit.

This modular system has several advantages, including the ability to upgrade, replace, interchange, or customize the jet system without destructive alteration of the shell. In addition, the joints at which water leaks are likely to occur are in regions that communicate with the shell water containment. Accordingly, most leaks are benign, which contrasts with traditional spa designs where all of the water supply is under the spa shell, and almost any leak will discharge water into insulation under-the shell and on the floor under the spa.

While the modular spa systems have many advantages, there are yet some difficulties. The water supply system of the modular spa is comparatively complex since each modular unit must include an assembly of a manifold with sealing connections to inlet and outlet water lines, several separate water lines from the manifold to each jet, and several air lines from an air supply manifold. This complexity and multiplicity of parts leads to higher manufacturing costs for the materials and higher labor cost in the assembly.

A simplified construction that provides the advantages of a modular spa, but has a simpler construction and is less expensive to build would be an advance in the art.

SUMMARY OF INVENTION

The present invention involves a bathing system comprising a shell molded to define a containment for containing water. The invention may be used in any suitable bathing system, such as a spa, bath or shower in which people or animals are massaged or bathed by water injected from jets or water agitated by injection of water through jets.

In the containment of the shell of the bathing system of the invention one or more depressions or hollows are molded into the shell. In the hollow is a water connector connected to a water supply system. A canister is dimensioned to fit in the hollow. The front surface of the canister is constructed as a jet plate, upon which is mounted one or more jets. When the canister is installed in the hollow the jets are disposed to inject water into the containment. The canister also has a water port that registers with and communicates with a water connection in the hollow. The canister has structure for water communication between the water port and the jets mounted on the canister wall, such that the jets are supplied with pressurized water from the water supply, through the water connection in the hollow, and the canister water port.

The canister is designed to be reversibly removable. By "reversibly removable" is meant that the canister can be installed, removed, and reinstalled without destruction of a component, usually by hand and without special tools. The intent is to permit an untrained consumer of average skill and physical ability to remove a canister and replace it with the same or another canister without the consumption or destruction of parts. Preferably, this can be accomplished by hand without tools, but it is contemplated that an ordinary tool (e.g., adjustable wrench or pliers, screw driver, etc.) may be used, particularly when the system is stuck or the user is not physically strong. Accordingly, fittings that are glued, welded or fitted with fasteners that required a customized or special tool would not be considered reversibly removable. In addition, fittings and fasteners that are not ordinarily intended to be accessed by the consumer would also not be considered reversibly removable. This contrasts with mechanical systems that are designed to be removed and replaced by dealer or shop personnel. These dealer systems designed for dealers often require training, special tools and skills.

In a preferred aspect of the invention, the jets are also provided with an air supply so that air can be injected from the jet along with the water. An air supply or source may be accessed through an air port in the canister that has air communication with an air inlet of each jet. There is a corresponding air connector in the hollow connected to the air supply so that when the canister is in an installed position in the hollow the air connector and the air port register in a manner to form a continuous air supply conduit from the air source to the jet.

In a preferred embodiment of the invention, the canister is preferably enclosed with a pod-like enclosed body, with only a single water inlet port and a single air inlet port. The structure for connecting the water port and the air port to the jet or jets on the jet plate is enclosed in the body of the canister. For interchangeability, canisters are manufactured with standard dimensions, so that canisters of different jet configuration can fit in the same standardized hollow. This involves making the canisters where certain external dimensions are the same, and where the water port and air port placement is the same. For interchangeability, the bathing system usually has more than one hollow with multiple hollows with dimensions standardized sufficiently to conform to a canister type. With this construction, using one or more standard hollow designs, the bathing system can be easily upgraded or repaired with new jets by an easy hand replacement of the canister with a new one with the same or different jets. In addition, the canister can be easily moved to another position in the bathing system.

A hollow or hollows are placed in the spa at each jet station. A jet station may include one or more of, for example, a reclining or back-rest surface, leg supports and massage, foot supports, foot massage stations, and foot wells. In addition, a hollow may be designed to hold more than one canister. For example, along the back rest surfaces of the benches in the spa, a jet station on the back reclining surface may be provided by a hollow containing a single canister. However, the canister can be divided so that hollow contains more than one canister to, for example, provide jet stations for the legs and the feet. A spa may have multiple occurrences of one or more different hollow configurations with the same hollow configuration at similar jet stations. For example, corner stations, side stations, foot stations, leg stations, etc., may all be in a spa in one or more locations. All similarly placed stations, for example, all of the side stations, have the same hollow configuration.

The internal structure of the canister has preferably a simple and inexpensive construction. Repair and upgrading of the spa jets is accomplished by removing and replacing the canister, and the consumer is not required to repair or otherwise modify the canister itself. The system for conveying water and air from the water and air ports to the jets may be by separate lines, but is preferably provided by internal cavities or chambers. For example, water can be conveyed through one or more pressurized chambers to the jets. The jets can be constructed with water and air inlets extending directly into or otherwise communicating with the chambers. The water and air chambers are supplied by the respective water and air inlet ports in the canister.

The canister has a front jet plate or panel upon which jets are mounted. When the canister is in the hollow, the jet plate surface corresponds to the visible surface inside the spa. For example, a jet plate can be configured as a reclining surface for a back, leg, or foot. In can also be designed to be adjacent to a body part for directing water for massaging the body part, such as for jets in a foot or leg well, or jets on an arm rest for the arms, or for the side of the torso. The jet plate is generally facing into the containment to allow a user to recline against the surface, or place a portion of the body near the jet plate. Water jets are designed for a therapeutic or relaxing effect to the user by ejecting water or creating a massaging effect against the body surface of the user that is upon or adjacent to the jet plate. The jet plate surface can be configured to provide a reclining or massaging surface for any part of the body, such as the back, neck, legs, arms, or feet, or any other body surface for which the relaxing and therapeutic effect of the jets is desired.

The jets may be of conventional construction mounted in the front panel or jet plate in any suitable manner. In addition, the water and air can be supplied though the canister to the jets in any suitable manner. For example, in a dual chambered design (water chamber and air chamber), which is described in detail below, the jets extend through the jet plate and through the chambers, with jet water and air inlets appropriately located in the correct chamber. In this embodiment there is no connecting of water and air lines for each separate jet, thus simplifying the construction of the canister.

In an aspect of the invention, all the jets in the canister are molded or mounted on a jet plate that can be interchangeably removed from the canister. Accordingly, a jet can be upgraded by changing the jet plate instead of the entire canister. In addition, canisters can be made to one standard design with only the interchangeable jet plates to provide various jet configurations.

DETAILED DESCRIPTION

Figure 1:
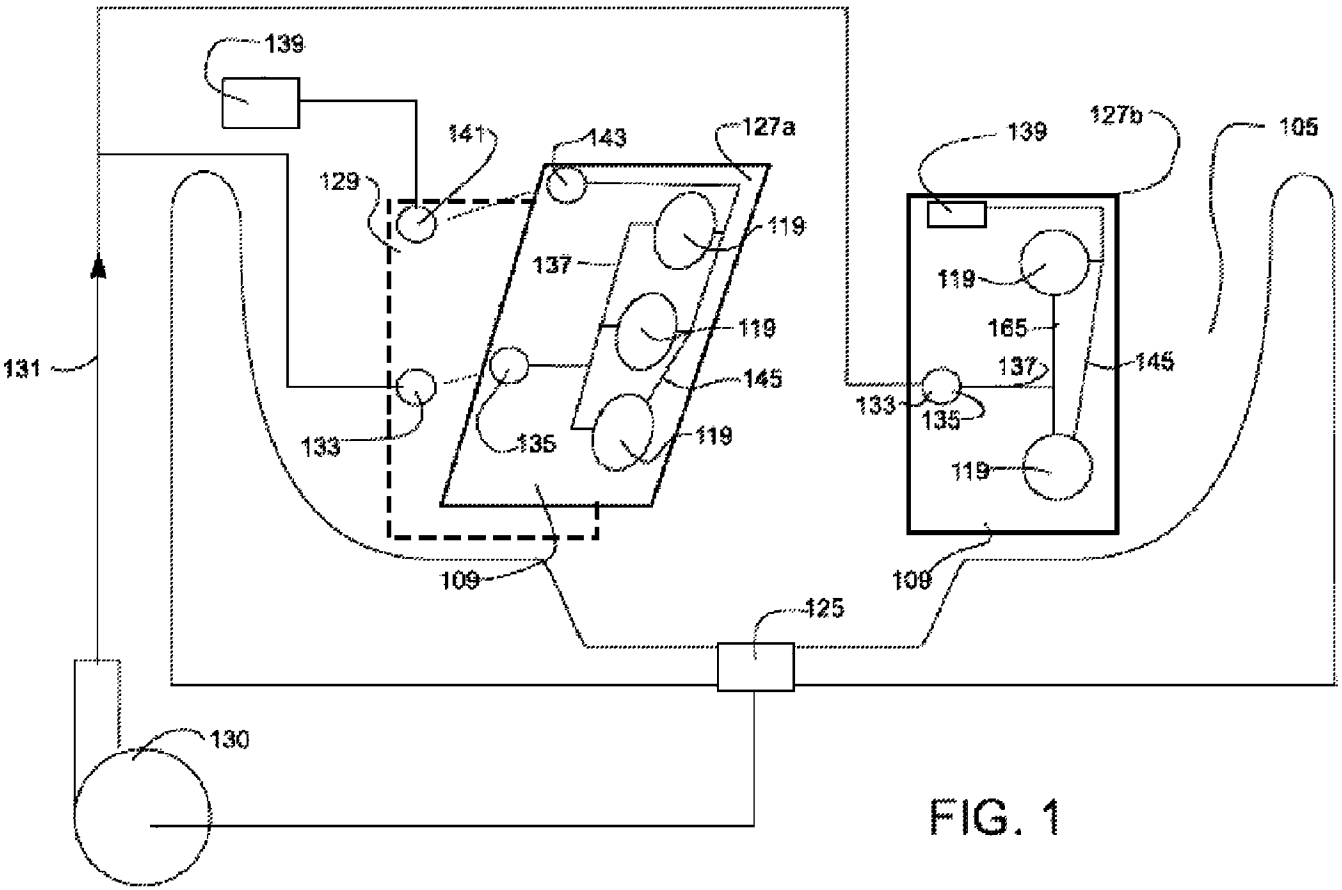
FIG. 1 is a schematic view of a water distribution system and removable canister system of the invention.

Reference now made to FIG. 1, which is a schematic diagram of an aspect of the invention. Water is drawn from the containment 105 through a drain 125, pumped through a water distribution or supply system 131 by pump 130 to each of the jet stations 109.

In conventional prior-art spa construction, water and air are supplied to the jet by separate supply lines that are respectively connected to a pressurized water circulation system and an air supply system. At stations where there are several jets, the result is a tangle of several water and air supply lines, as each jet requires its own set of lines. In the prior-art modular spa systems, jets are mounted on a modular unit that is supplied by a single water supply line, but within the modular unit, each jet is supplied by separate water supply lines from a water manifold. The air supply is usually also provided by separate air supply lines, one to each jet. For a reclining station with several jets, this multitude of supply lines can become complex and expensive and become more difficult to repair and maintain.

In contrast to traditional spa construction, the present invention comprises an interchangeable canister construction that allows for a single water feed and a single air feed instead of multiple feed lines.

Referring again to FIG. 1, the water distribution system 131 functions to carry water to water connectors 133, with a water connector 133 disposed in the hollow 129 at each station. The water jets 119 are mounted on a jet plate 117 that is part of a removable and interchangeable canister 127*a*, 127*b* or modular unit. There is a canister for each station 109. As illustrated for canister 127*a*, the canister is removable, and includes a water port 135 than connects to the water connector 133 when the canister is in the hollow. If air is required for the jets in the canister, air can be provided through an air supply system 139. The air supply system may be external to the canister, as in 127*a*, and connect to the canister by mean of an air connector 141 in the hollow connecting to an air port 143 on the canister. The external air supply system may be in any suitable location in the spa system and may comprise an inlet structure open to the atmosphere, or be a compressed air source, such as a compressor or compressed air tank. Alternately, the air supply system 139 can be incorporated into the canister, as in 127*b*, and be any suitable structure such as an opening to the atmosphere. The canister incorporates an integral jet water distribution system 137 to convey water from the water port 135 to the jets 119, and an integral jet air distribution system 145 to convey air from the air port 143 to the jets 119.

Figure 2:
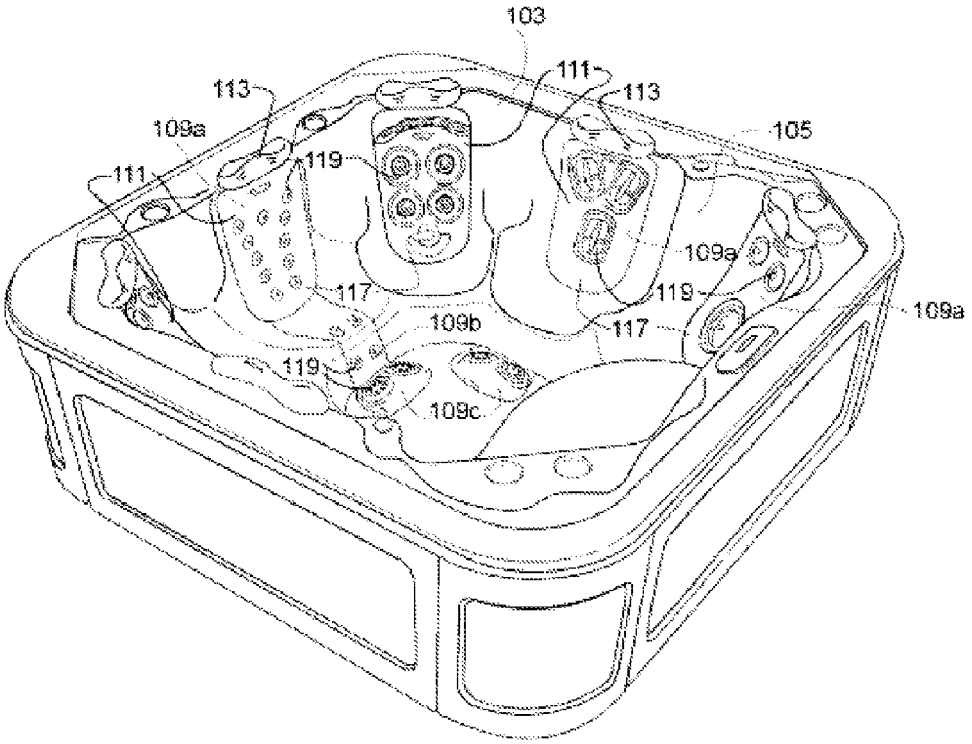
FIG. 2 is a perspective view of an example of a spa of the invention.

Reference is also made to FIG. 2, which is a view of an example of a spa of the invention. A spa may have multiple occurrences of hollows and one or more different hollow configurations. For example, corner stations, side stations, foot stations, leg stations, shower stations etc., may all be in a spa in one or more locations. A canister has a surface that includes the jet plate 117 upon which jets 119 are mounted. The jet plate 117 provides a visible surface to bather and is usually continuous with the surface of the containment. Depending upon the nature of the jet station, the jet plate provides the surface against which the bather reclines (e.g., a foot, let, or back rest). The canister 127 is mounted in the hollow 129 or depression molded in the shell, which is configured and dimensioned to receive the canister 127.

Referring to FIG. 2, the shell is molded and the spa constructed to provide jet stations 109*a*, 109*b*, 109*c*, each with jets 119 directing water into the containment. Back rest jet stations 109*a* each have a reclining or resting surface 111 for a bather, including a head rest 113, such as a molded pillow, that is integral or separate from the shell. The jets 119 on the reclining surface 111 direct water against a reclining bather. Leg rest jet stations 109*b* are designed to provide a resting and massaging surface for legs and has jets 119 directing water upon the legs. Foot jet stations 109*c* are disposed at or near the feet of bather with jets 119 to direct water upon the feet of a bather. Each station may have the same or different jet constructions, depending on, for example, the desired force, volume and feel desired by the user.

Figure 3:
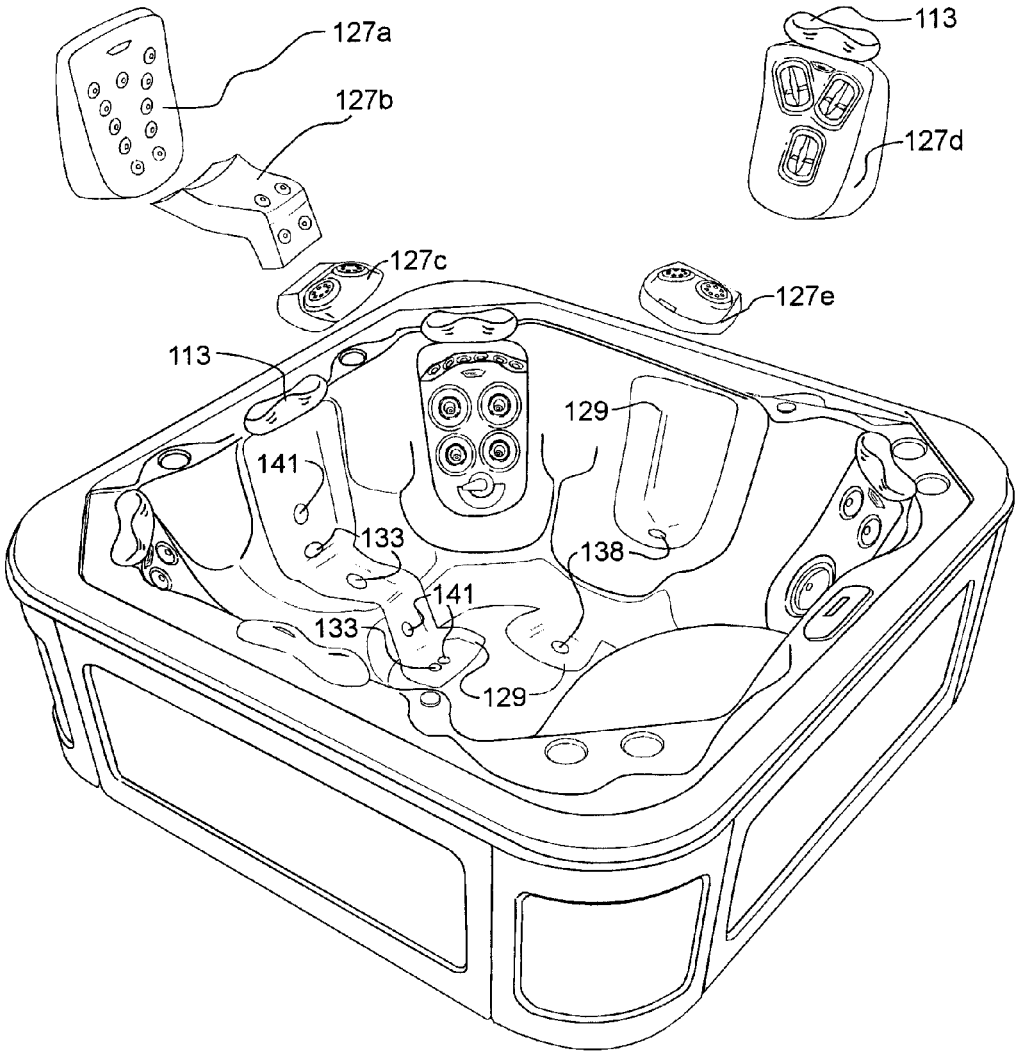
FIG. 3 is the view of FIG. 2 with selected canisters removed from hollows.

With reference also to FIG. 3, which is the spa in FIG. 2 with selected modular units or canisters 127 removed. The canisters 127 are removed with the jet plate 117 upon which the jets 119 are mounted along with their canister water and air distribution systems 137, 145. With the canisters removed, the water connectors 133 and the air connectors 141 in the hollows are visible. These connect with respective water ports 135 and air ports 143 on the canisters 127 (not shown in FIG. 3). It is also contemplated that a hollow and its canister be equipped with a single combination connector 138 and combination port 136, that provides both water and air.

For illustration a variety of canister/hollow configurations are shown. In actual practice, a spa would probably have more standardized hollow/canister designs such that canisters can be interchanged within the spa and with other spas. Canisters 127*a*, 127*b*, and 127*c*, are configured to fit in a single hollow. The three canisters together form in effect a large single subdivided or segmented canister. With this design, one or more of the back, leg or foot rest can be interchanged for another like canister with a different jet design. Jet stations may also have hollows with only one canister, as with 127*d*, and 127*e*. As can be seen in this example, hollows can be designed to contain one or more canisters of suitable configuration. The canisters designed to fit a single hollow design can differ not only in jet configuration, but also, for example, in external contour (e.g. head rest) and texture.

Figure 4:
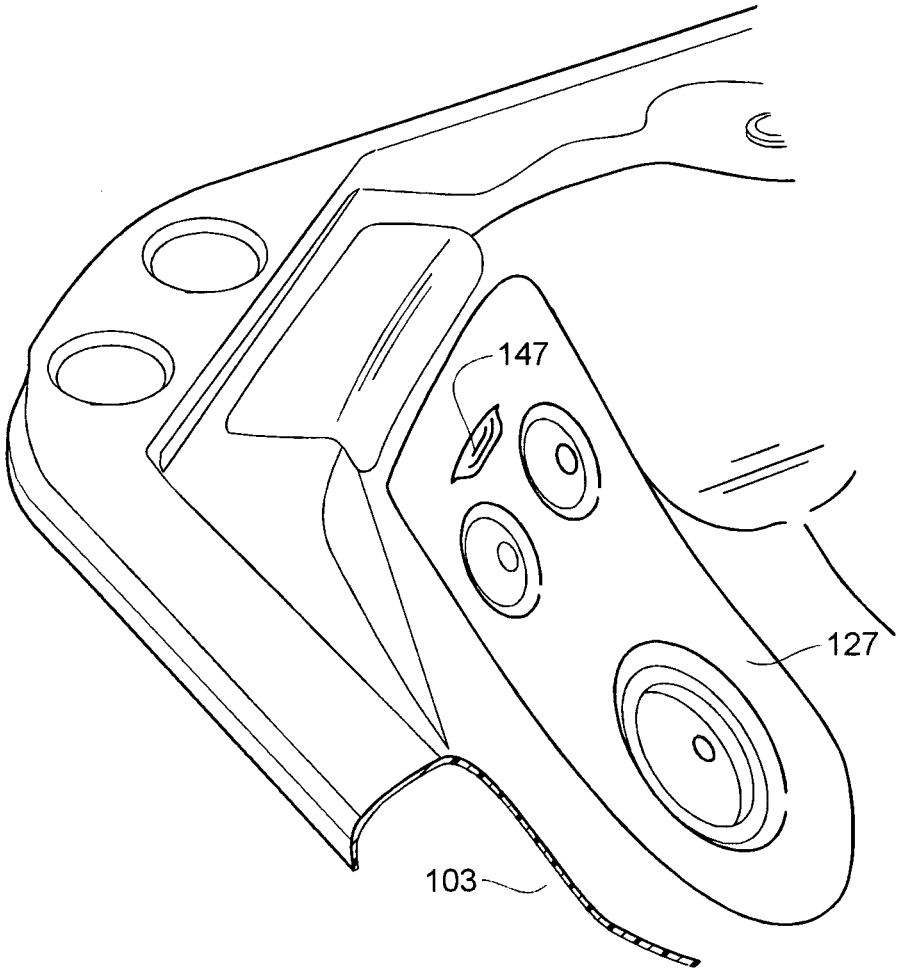
FIG. 4 is a detail view of a jet station.
Figure 5:
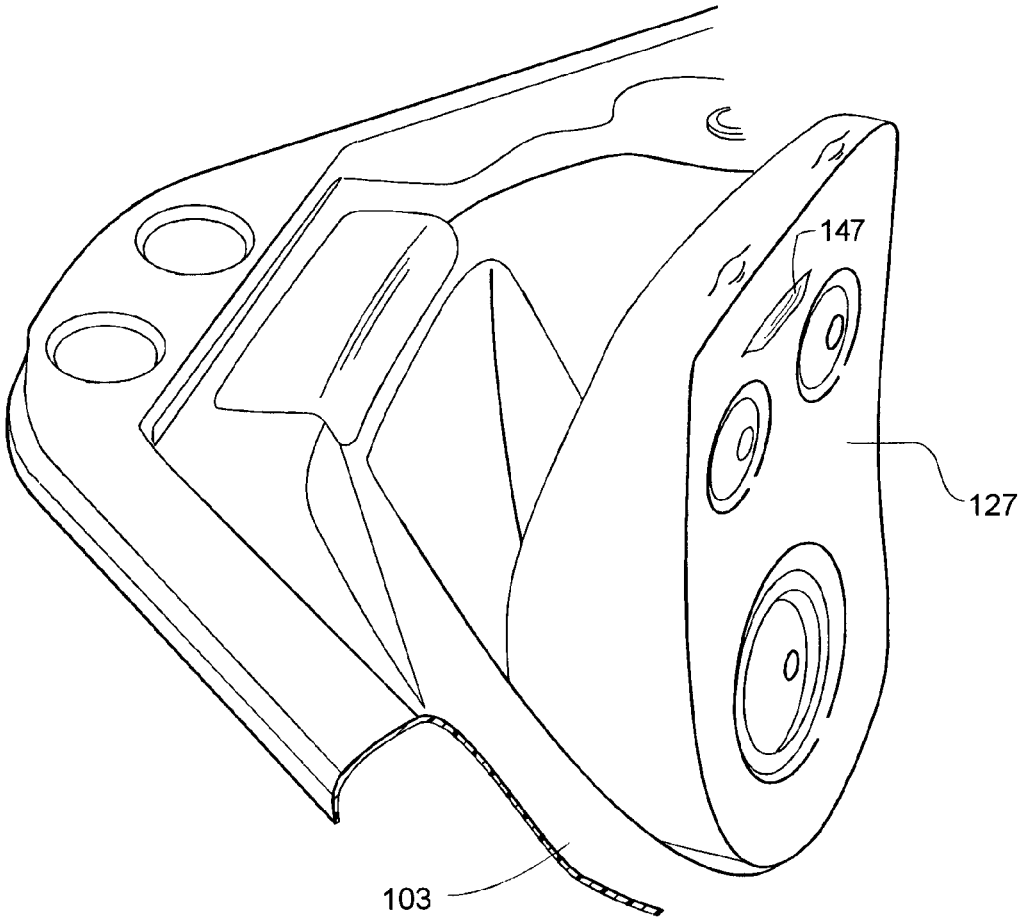
FIG. 5 is a detail view as in FIG. 4 showing removal of the canister.

Reference is also made to FIG. 4 and FIG. 5, each showing a detail of a corner back jet station as in FIG. 2. FIG. 5 is the jet station of FIG. 4 with the canister partially removed. As shown in FIG. 5, the canister 127 can be removed from its installed position (FIG. 4) by pulling the canister out from the shell 103. Reinstallation of the canister is by reversing the motion. A handle 147 molded into the canister can be used to assist in the installation and removal.

Figure 6:
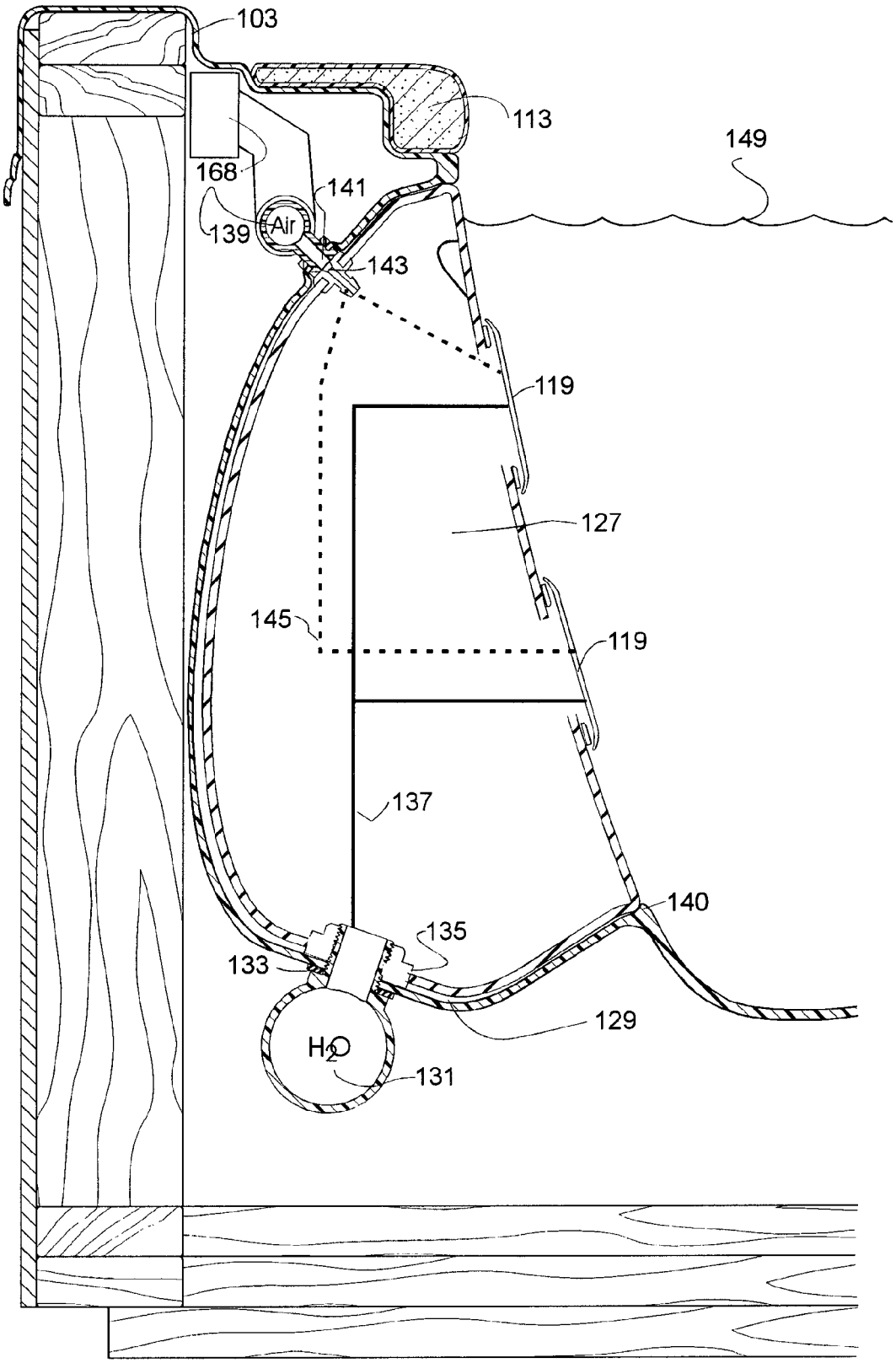
FIG. 6 is a cross-sectional view of an exemplary jet station.
Figure 7:
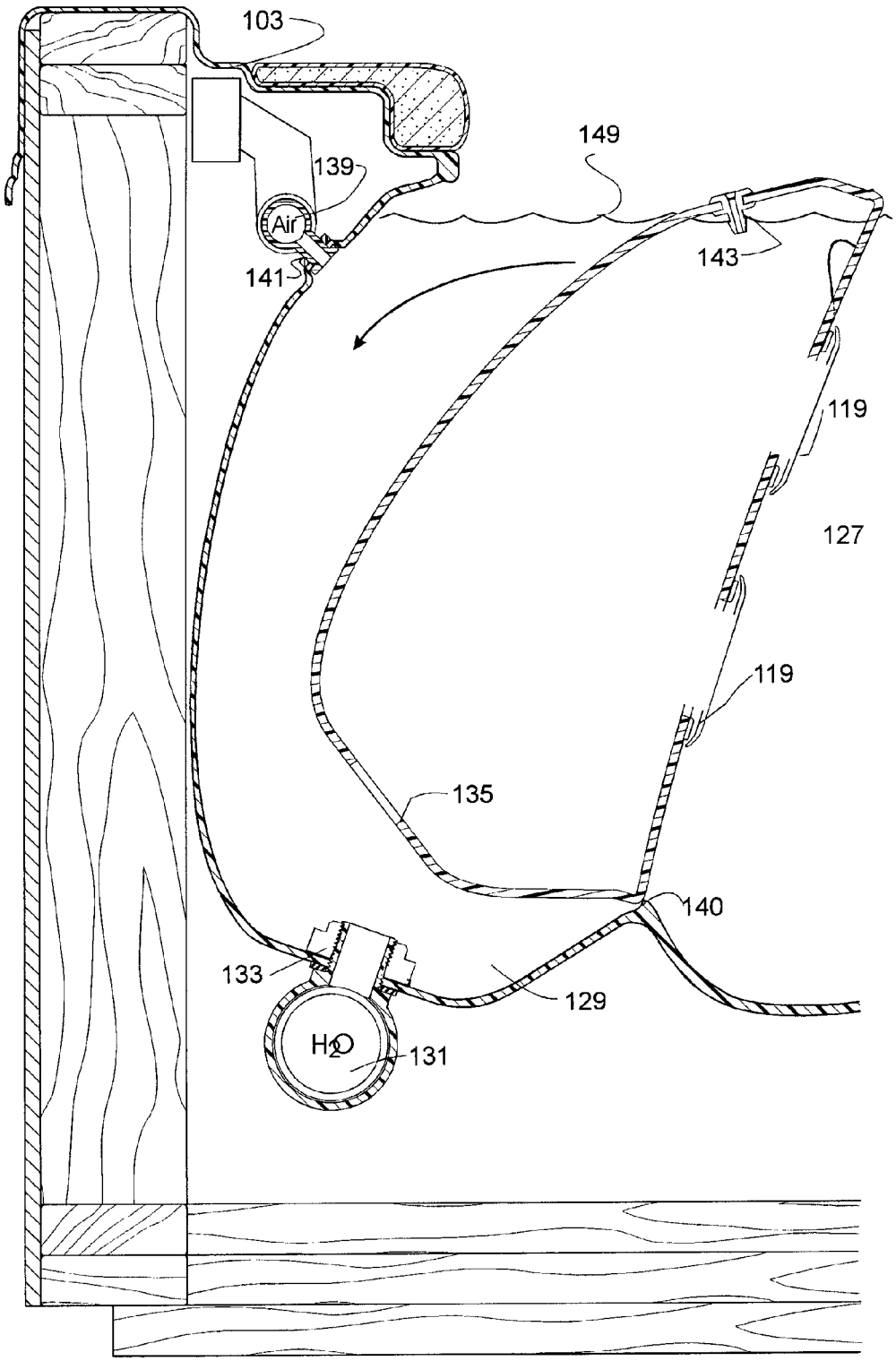
FIG. 7 is a view as in FIG. 6 showing removal of the canister.

Referring again to FIG. 1, and also to FIG. 6 and FIG. 7. FIG. 6 shows a jet station in cross-section, with a canister in the hollow. FIG. 7 is the same as in FIG. 6 with the canister partially removed. When the canister 127 is installed, as in FIG. 4, a water port 135 in the canister 127 registers or aligns to connect with the water connector 133 in the hollow 129 to provide a continuous water conduit from the water distribution system 131 to the interior of the canister. The water connector 133 and the water port 135 are provided with seals, or the like, at their union to maintain the pressure of the water for the jets 119. A total leak free connection is not required, as leaking water will run harmlessly into the containment, but sufficient pressure should be maintained for operation of the jets. In the interior of the canister is a jet water distribution system 137 to direct water from the water port 135 to the jets 119 (shown schematically in FIG. 6 and described in detail below).

To supply air to the jets, an air supply system 139 is connected to an air connector 141 in the hollow 129. When the canister 127 is in the installed position, a single air connector 141 registers with a single air port 143 in the canister to provide a continuous air conduit from the air supply system 139 to the interior of the canister. In the interior of the canister, a jet air distribution system 145 distributes air from the air port 143 to the jets 119 on the jet plate 117 (shown schematically in FIG. 6 and described more particularly below). The air supply system 139 may be an air opening to the atmosphere mounted in the canister, in which case there is no air port in the canister and the air inlet is connected directly through appropriate conduits to the canister air distribution system. The air supply system 139 may also be an air inlet mounted above the water line 149 (for example, under the shell 103). The air inlet may be of any suitable construction that provides an opening to the atmosphere. The air supply system 139 may also comprise a source of compressed air, such as, for example, a compressed air tank and/or a compressor.

The water jets 119 in the present invention function similarly as in traditional spas, to inject water under pressure into the containment. As described in detail below, jets of conventional construction may be used in the present invention, or jets of custom construction for particular flow patterns or canister construction can also be used. Preferably the water flow through the jet creates a venturi effect to create a partial vacuum to draw air from the jet air inlet into the jet of water that is expelled from the jet. The air may also be injected into the jet under pressure. The injection of the air with the water into the containment from the jet creates a perceptibly more forceful jet to the bather.

Referring particularly to FIG. 7, when the canister 127 is removed, the union between the water connector 133 and the water port 135, and the union between the air connector 141 and the air port 143 is broken. When installed, the canister can be held in the hollow (FIG. 6) by the union between the water connectors and water port, and/or the union between the air connector and the air port. Additional mechanical aids, or mating contour surfaces between the canister and shell, can be used to secure the canister. For example, a lower locking ridge 140 can be optionally provided that secures the canister and also provides a fulcrum for tilting the canister in and out of the hollow.

Figure 8:
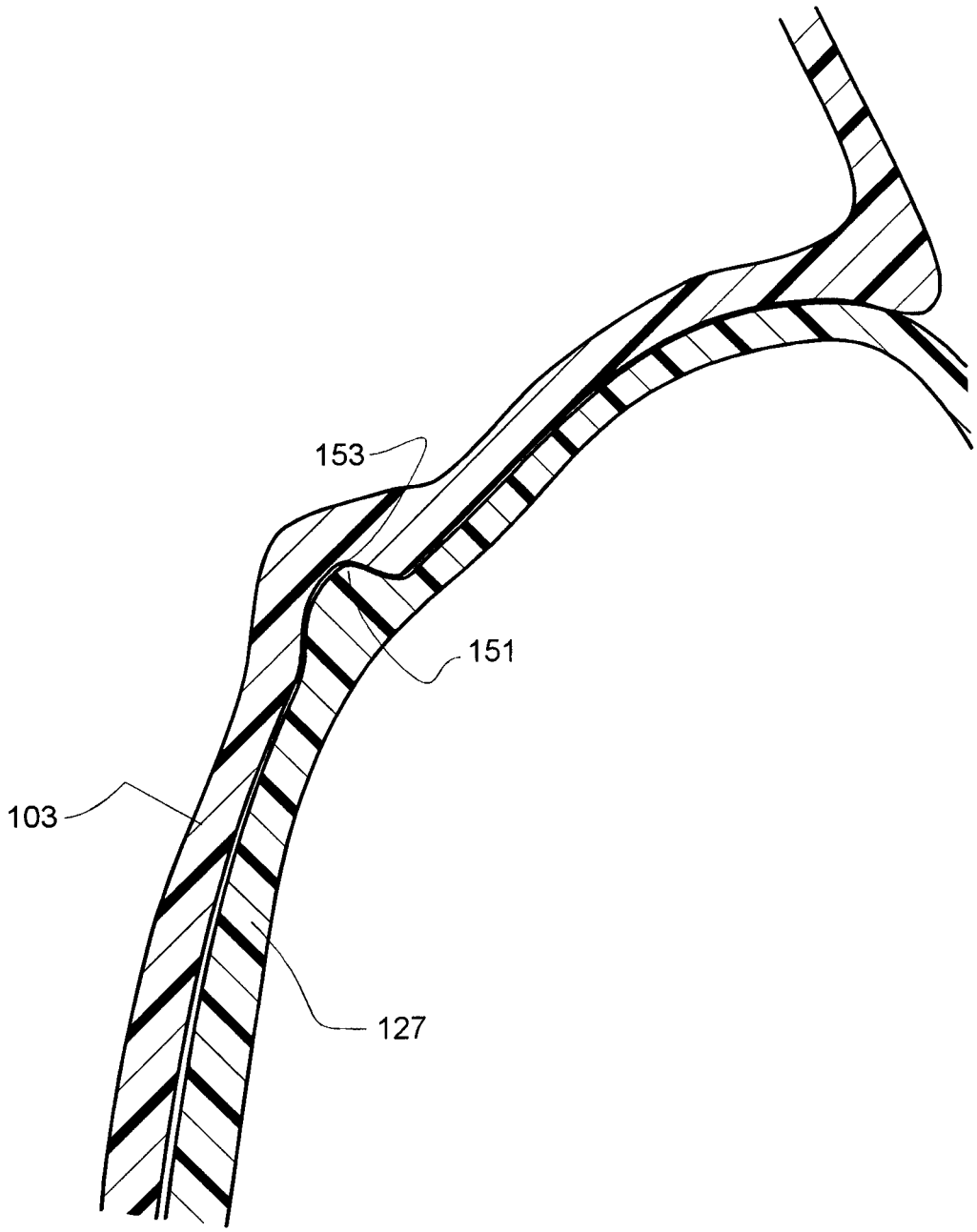
FIG. 8 is detail view showing a locking ridge between a canister and the hollow.

In FIG. 8, is illustrated another locking system, showing a detail of an upper locking ridge system. An upper ridge 151 on the canister 127 interlocks with an upper groove 153 molded in the hollow shell 103 to provide a lock.

Referring again to FIG. 6 and FIG. 7, the canister water port 135 connects when the canister is installed to a suitable water connector 133 in the hollow. The water connector is supplied with water by any suitable water distribution system, such as that illustrated in FIG. 1 through pipes under the shell or a system with a circumferential feed line around the periphery of the spa containment (such as disclosed in U.S. Pat. No. 5,987,663). The requirement being in the present invention that the water supply lines penetrate the shell at the location of a water connector 133 for functional connection with a water port 135 on a canister 127.

As more particularly shown in the description below, in a preferred embodiment of the invention each canister has a single water port 135 to the canister for a water supply, and likewise a single air port 143 for an air supply. However, multiple water and/or air connector/port combinations are contemplated by the invention. The present invention is designed such that the air and water connectors and ports are disconnected and reconnected with the removal and reinstallation of the canister. Thus, the disconnections or connections are basically made in a single operation, rather then several operations required in prior-art systems where hose and manifold connections have to be disconnected before jets or jet assemblies or modular units are removed. Since water port or ports 135 and air port or ports 143 for each canister are disconnected at the same time during removal, the installer is not confronted with removing several water and air connections to accommodate several jets. In addition, working with complex water supply manifolds with several supply lines can be avoided. A single water port and single air port are preferred, as fewer ports are simpler to configure and construct for this function. From these few canister connections in the hollow, all of the jets on a canister are supplied through the canister distribution systems.

The present invention derives its simplicity by providing a removable, interchangeable canister with the structure to distribute water and air to individual jets in the removable and replaceable canister. For certain considerations, such as mechanical stability to lock the canister in the hollow at several points, the water connector or the air connector, may be partitioned, branched or forked with more than one outlet to the port or ports on the canister. However, any construction using single, branched, or multiple ports should function as described.

Figure 24:
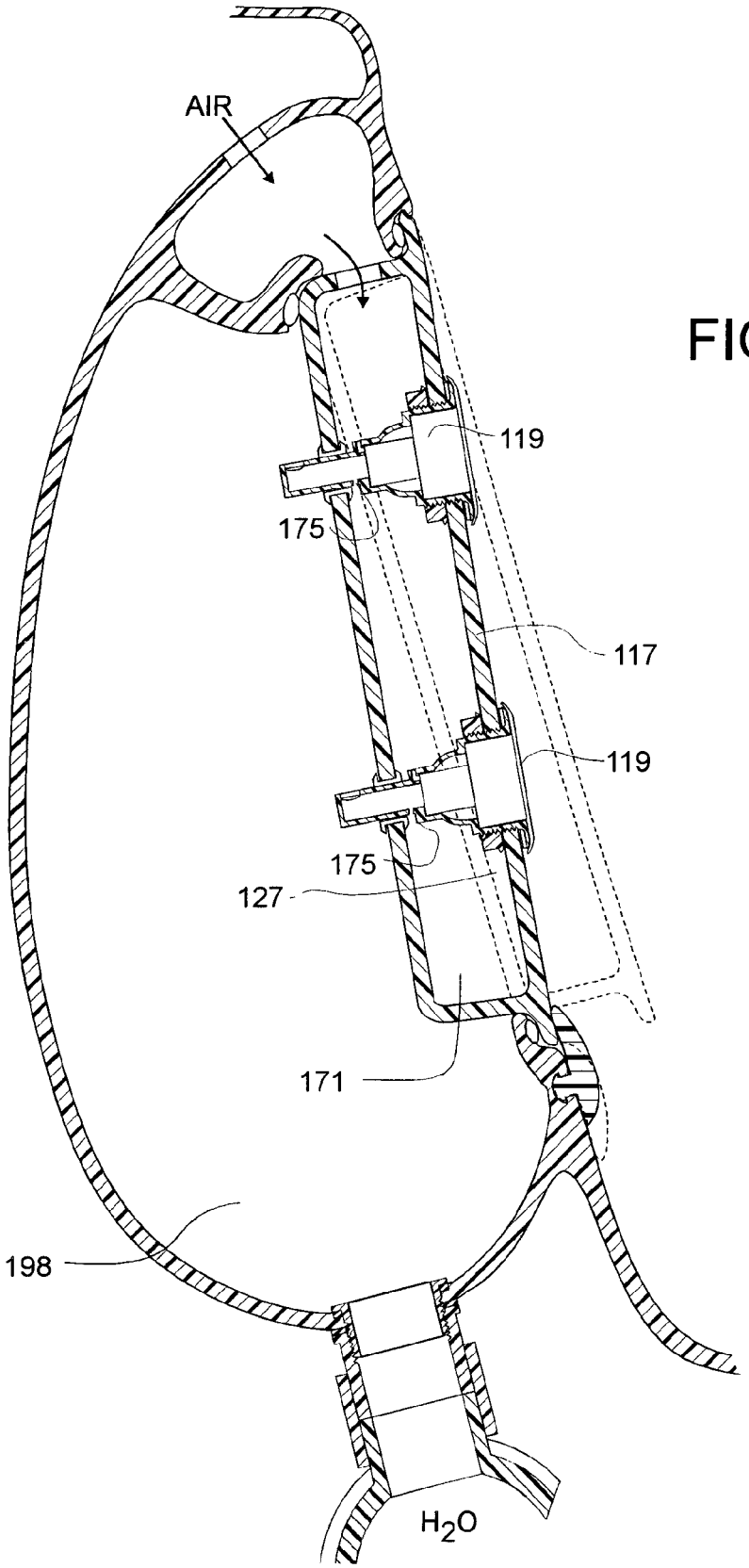
FIG. 24 is a cross-section of an alternate canister construction with a removable jet plate.

The present description refers mainly to canisters with two distribution systems, i.e., a water distribution system 137 and an air distribution system 145. However, other combinations are contemplated, such a canister with only one (water or air) distribution system and jets that use only water or air. In addition, there may be more than one water distribution system, for example, a high pressure and a low pressure system for two different kinds of jets, or to power a mechanical device in the canister. The mechanical device may be anything suitable, such as a therapy device. There may also be multiple air supply systems, e.g., an atmospheric air supply, and a compressed air supply, for different jet types or to provide a power source. The distribution systems are generally in the form of chambers or conduits within the canister. But it is also contemplated that one or more of the distribution systems include a space between the back of the canister and the back wall of the shell. Such a system is shown in FIG. 24 and is described below. It is also contemplated that other auxiliary systems be included. For example, for electrical power an appropriate system of electrical connectors can be provided for electrical transmission between the hollow and the canister.

The canister is locked into the hollow to maintain the conduits of the water and the air into the canister, and to prevent movement when the canister is pressurized with water during use and a bather is reclining against the jet plate surface. The canister may be locked by designing the water connector/port and/or the air connector/port to provide a lock. In addition, the canister and hollow may comprise interlocking structures and ridges, simple toggle locks, latches or the like. In general, a canister will use a combination of locking systems to secure the canister to prevent its accidental removal during use and provide for removability. In an aspect of the invention, the canister is secured in the hollow by at least a two locking structures. The locking structures may include any suitable system, such as a locking water connector/port structure, a locking air connector/port structure, additional latches, and interlocking or mating locking ridges molded into the shell and the canister. To assist in removal and installation, handles or holding ridges may be molded into the canister.

The canisters are designed to fit into the hollow by hand, with only minor or occasional use of tools, and to be likewise removable. Accordingly, the canister is reversibly removable as described above. Since it is reversible removable it can usually be removed and installed without destruction of a component and without special tools. The canister can be configured with any suitable structure consistent with its reversible-removability. Such structures can be configured to t lock to canister in the hollow, assist in removal or installation, or the like. For example a molded handle 147 may be provided to assist in removal and installation of the canister.

The description of the invention has been made mostly with reference to a spa, but it is contemplated that the invention is applicable to other bathing systems wherein water is injected upon a bather or injected into a containment for a massaging or therapeutic effect. Such bathing systems include, but are not limited to, any system with jets, directed either below or above the water line, and than can be constructed with hollows and canisters. These include agitated bath tubs (e.g., Jacuzzi™, whirlpool), medical treatment and therapeutic bathing systems, wading and swimming pools, veterinary treatment baths, shower systems, and the like.

Figure 9A:
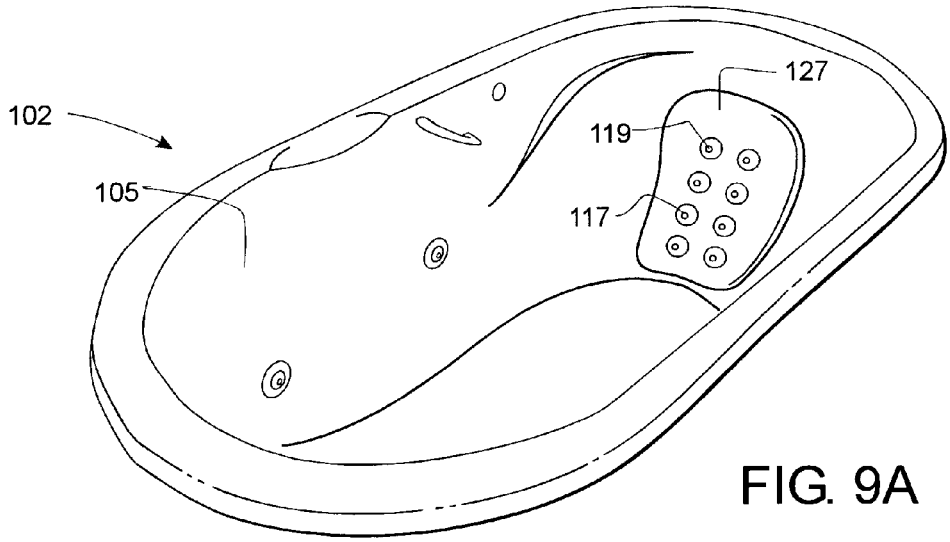
FIG. 9*a* and FIG. 9*b* are perspective views showing application of the invention to a different bathing system.
Figure 9B:
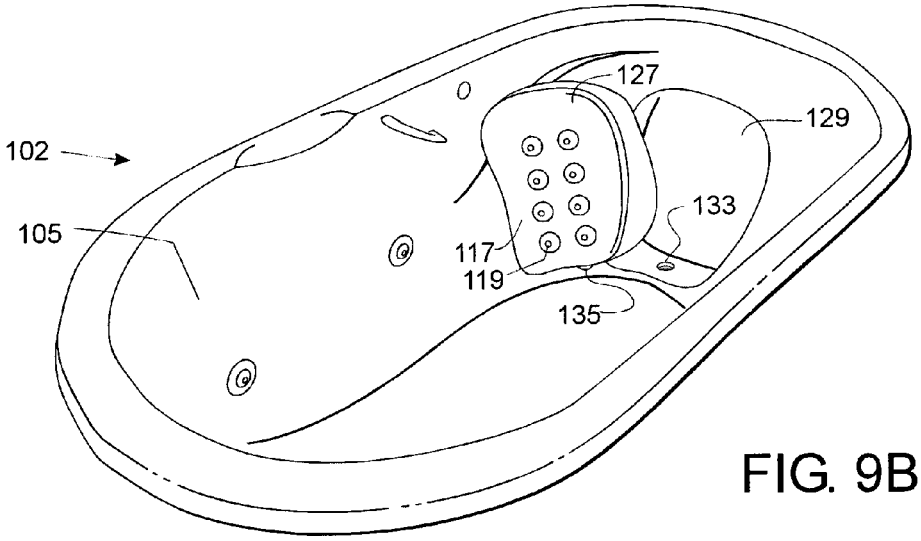

In FIGS. 9A and 9B is shown an embodiment of the invention that is a modification of a whirlpool bath design. This embodiment is based upon the Sensacia™ whirlpool bath available from Mansfield Plumbing Products, LLC, Perrysville, Ohio. The bath 102 comprises a shell 103 to provide a water containment 105. Rather than mounting jets 119 directly in the shell, a hollow 129 in the shell is provided. A canister 127 fits in the hollow. The canister has a jet plate 117 upon which are mounted the jets 119 and which provides a continuous reclining surface (see FIG. 9A). The canister 127 can be removed as shown in FIG. 9B, and replaced, to either effect repair of the jets or to upgrade or change the jets. A water connector 133 is provided to register with a water port 135 on the canister 127. The interior of the canister is designed to provide a continuous channel between the water port and the jet, through which water is injected into the containment. In this embodiment, no air is injected with the water. However, the connector/port can be replaced with a combination fitting to provide both water and air connections, or the hollow, canister can be otherwise modified to also provide an air supply.

Figure 10A:
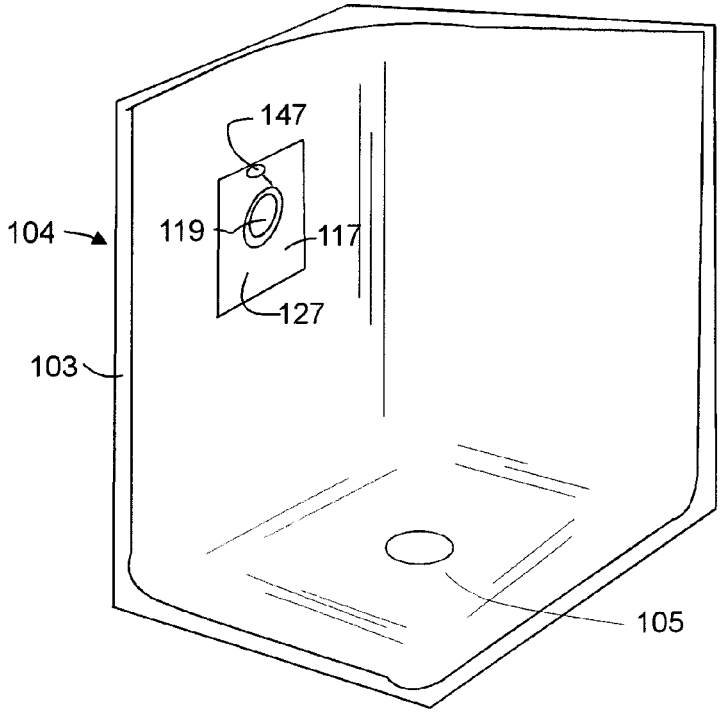
FIG. 10*a* and FIG. 10*b* are perspective views showing application of the invention to yet a different bathing system.
Figure 10B:
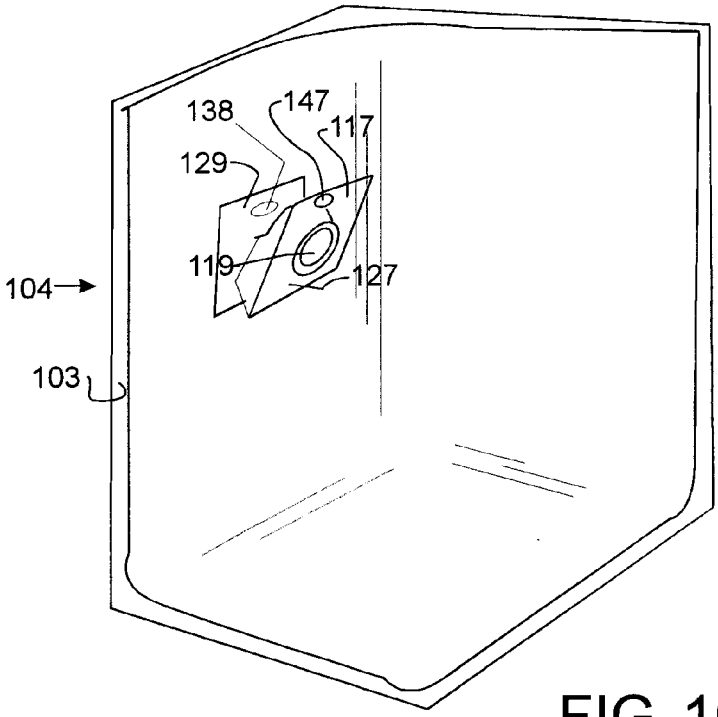

In FIGS. 10A and 10B is shown a shower embodiment of the invention. The shower 104 comprises a shell 103 with containment or drain pan 105 to provide a bathing enclosure. Rather than mounting a shower jet 119 directly in the shell, a hollow 129 in the shell is provided. A canister 127 fits in the hollow. The canister has a jet plate 117 upon which is mounted the shower jet or jets 119. The canister 127 can be removed (using handle 147) as shown in FIG. 9B, and replaced, to either effect repair of the jets or to upgrade or change the jets. A water/air connector 138 is provided to register with a water/air port (not shown) on the canister 127. The interior of the canister is designed to provide a continuous channel between the water port and the jet, through which water is injected into the containment. Here in these figures is shown a combined air/water connector, but a water only connector can be also used, with the connector interlocking with an appropriate water only port.

EXAMPLES

In the construction of an upgradeable spa of the invention, there are at least two aspects to consider:

(1) The construction and dimensions of the hollow and the canister that fits in the hollow, along with placement and construction of the water and air connections in the hollow, and the corresponding water and air ports in the canister, and (2) The internal distribution construction of the canister to convey water and air to the jet or jets on the jet plate of the canister. It is understood, that once the standards in (1) have been established, the internal construction (2) of a canister can be any functional system, and still it will be interchangeable with a canister of a different internal construction. Accordingly the invention will now be described with separate reference to these aspects.

Examples of Canister/Hollow Configurations

Reference is again made to FIGS. 2 to 10B, which show examples of suitable hollow/canister configurations and port placements. In FIG. 3, for example, the water connector 133 is shown at or near the bottom of the hollow 129, with the air connector 141 at or near the top of the hollow.

Figure 11:
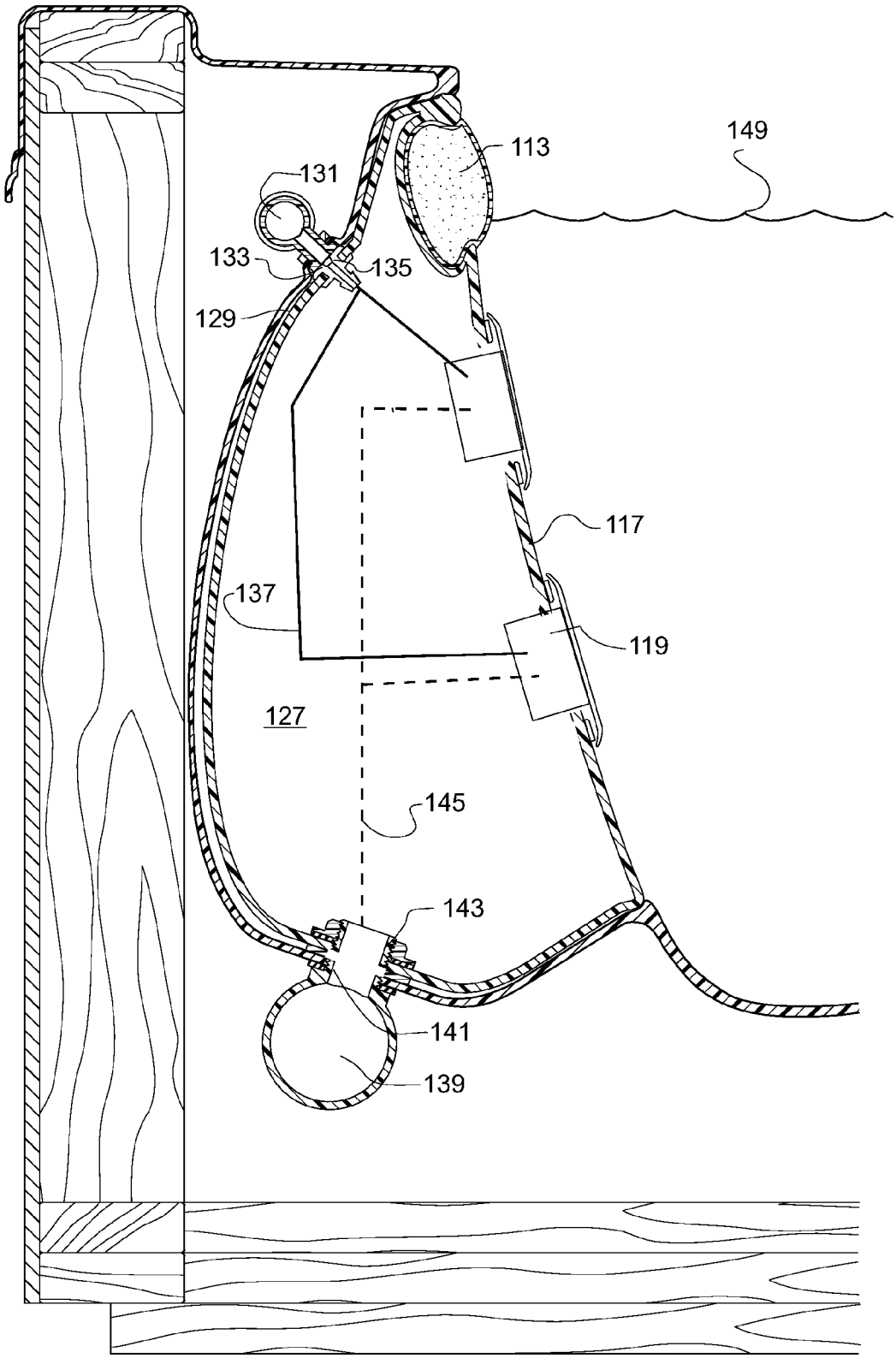
FIG. 11 is a cross-sectional view of another exemplary jet station.
Figure 12:
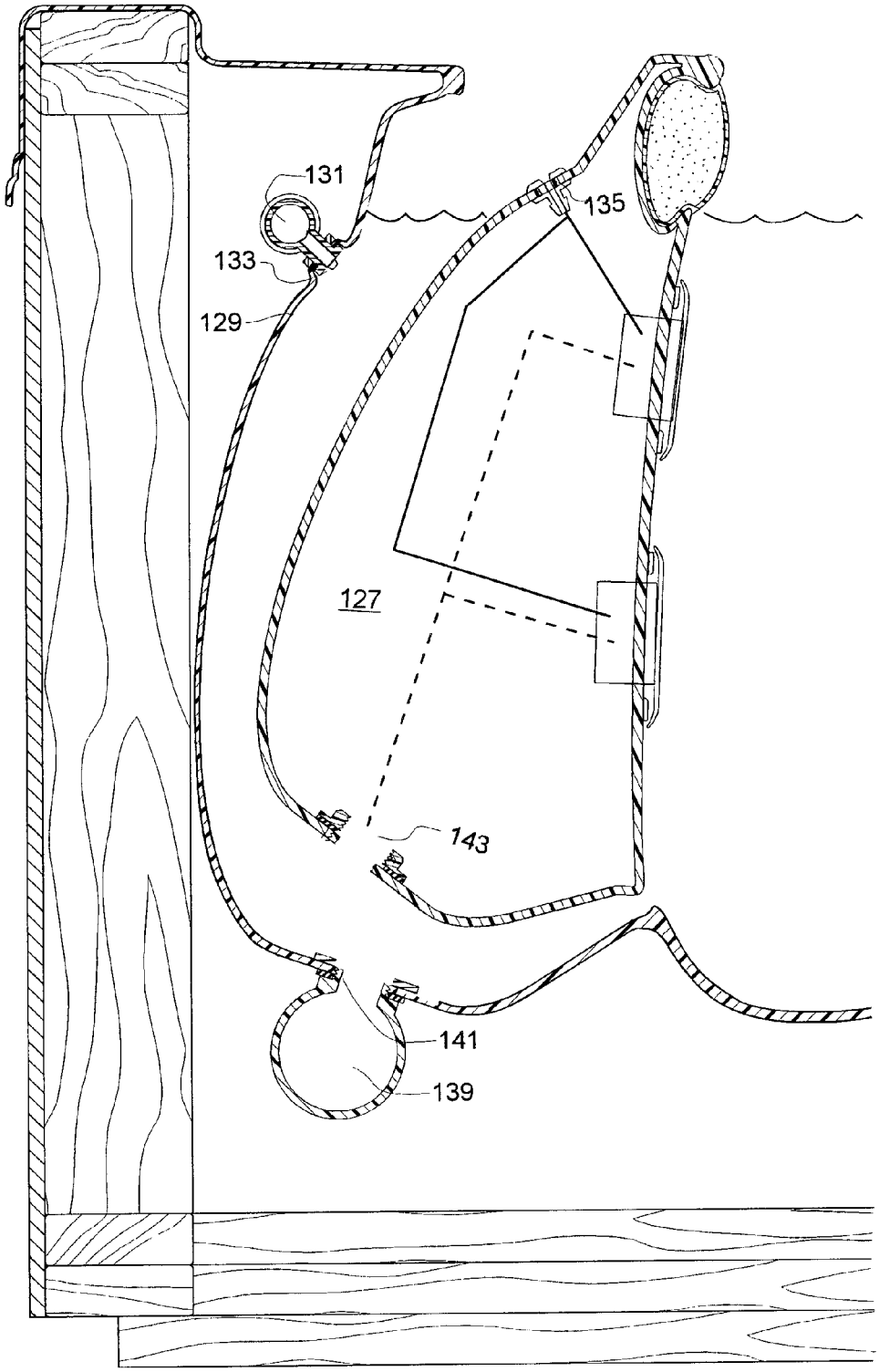
FIG. 12 is a view as in FIG. 11 showing removal of the canister.

Reference is also made to FIG. 11 and FIG. 12, which show another configuration. In these figures the water connector 133 is near the top of the hollow 129. This configuration is adaptable to an upper peripheral water supply distribution system 131 as disclosed in the above prior-art patents. The air connector 141 is shown near the bottom. In this embodiment, there may be a common air inlet for all of the stations with an air conduit or supply system under the shell near the bottom. In the alternative, a separate air inlet may be provided under the shell for each station as in FIG. 6. The head rest 113 may also be molded or inserted into the canister 127, as shown in FIG. 12, instead of a head-rest 113 molded into the shell 103 (FIG. 6). In FIG. 12 the canister 127 is removed by breaking the union between the water connector 133 and the water port 135 in the canister 127, and the air connector 141 and the air port 143, and moving the canister from the hollow. This is done in one movement by grasping the canister near the top and pulling sufficiently to break or disconnect the connector/port connections and disconnect any locking structures.

Figure 13:
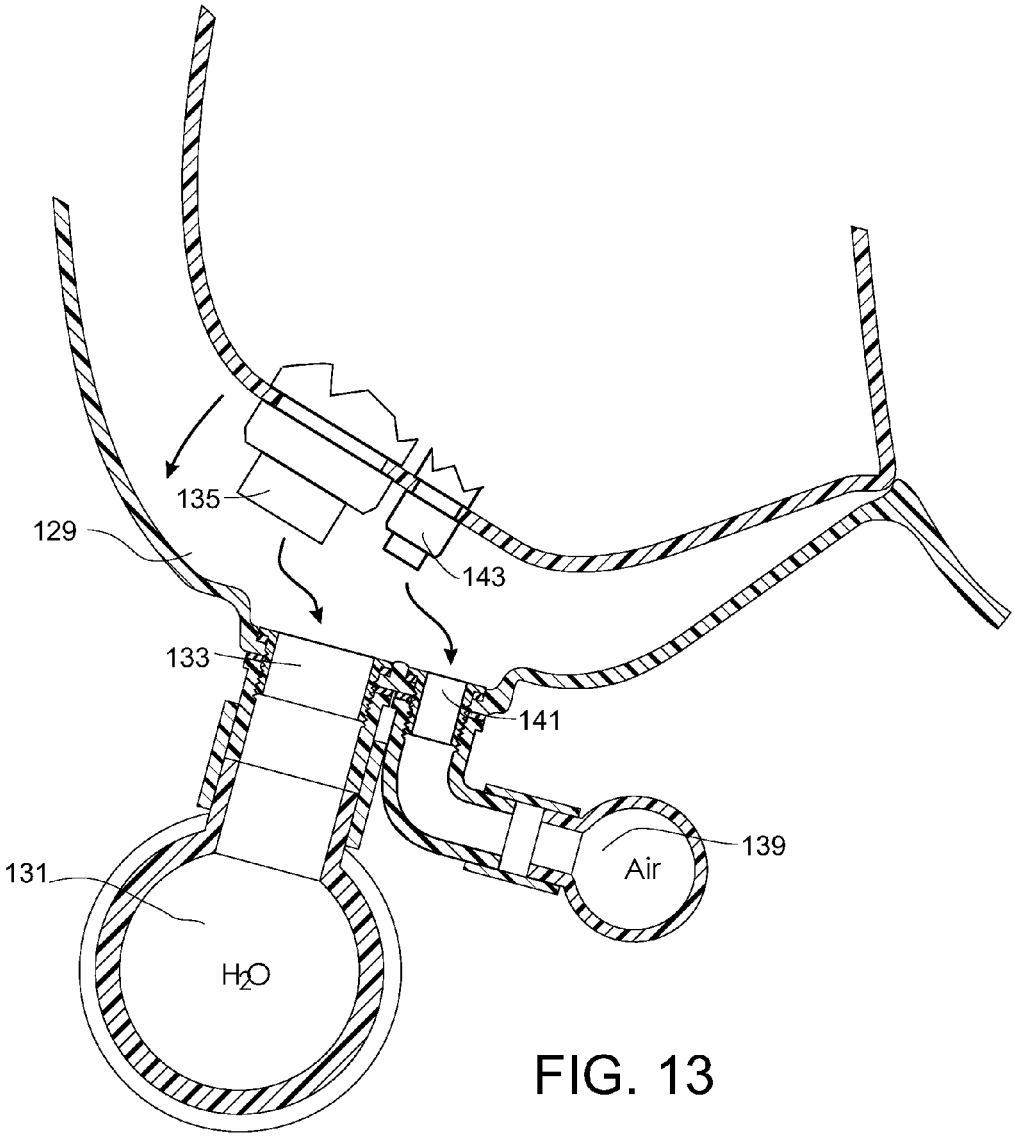
FIG. 13 is a detail view showing an example of water and air ports of a canister and corresponding water and air connectors in a hollow.

Reference is now made to FIG. 13, which shows another arrangement for the water and air connectors in the hollow. The water connector 133 is disposed at any suitable place in the hollow 129. Here the connector is near the bottom but any suitable location in the hollow is contemplated. Adjacent to the water connector 133 is mounted the air connector 141. Both are supplied by suitable water distribution and air distribution and supply systems 131, 139. The water and air connectors 133, 141 register to form suitable water and air conduits with water and air ports 135, 143 on the canister 127.

Figure 14:
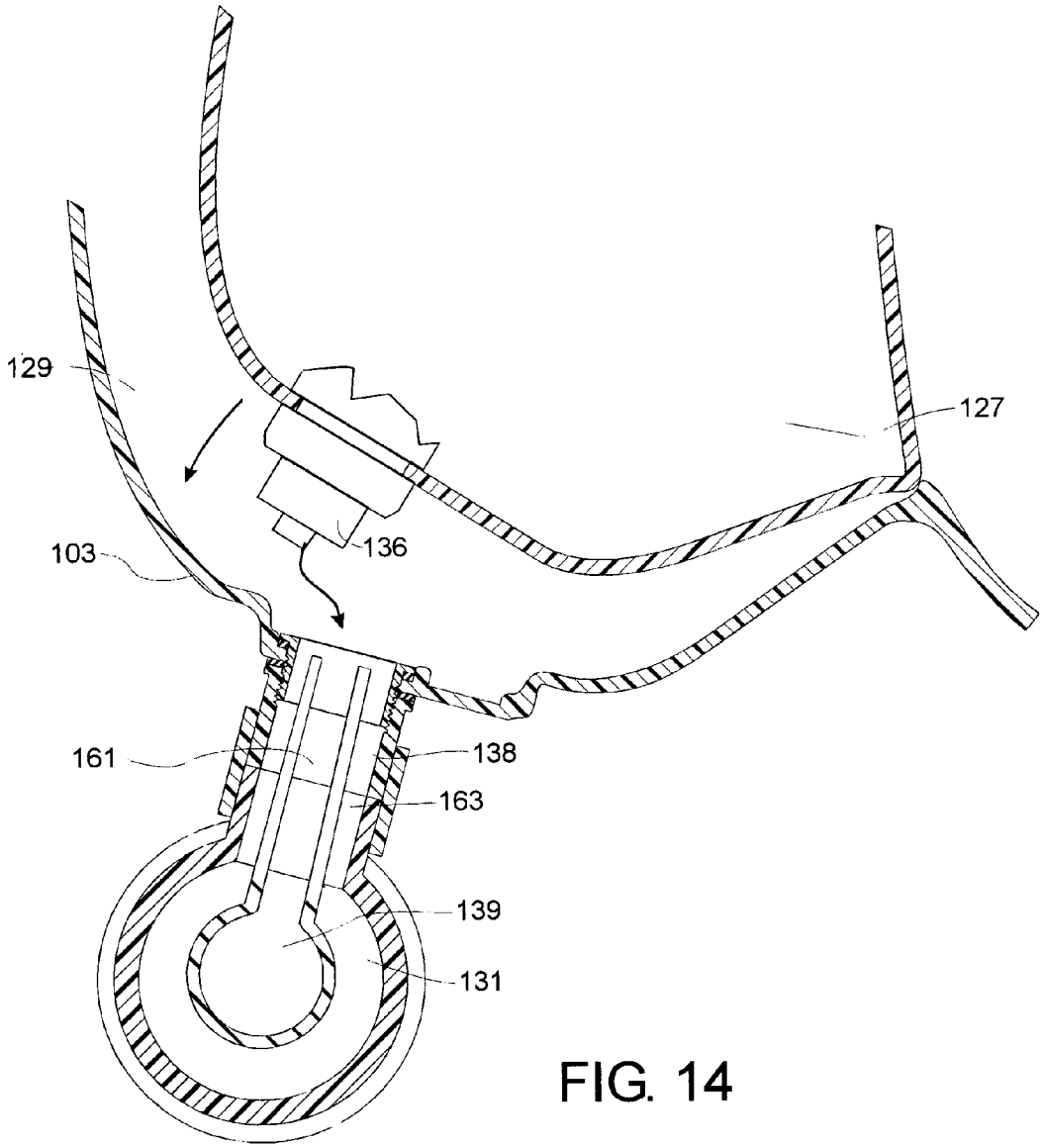
FIG. 14 is a cross-sectional view of a portion of a canister and hollow showing an example of a system using an integrated water/air port and an integrated water/air connector.

Reference is now made to FIG. 14. A water connector and air connector are mounted together as an integrated structure 138. In FIG. 14 an integrated water/air connector 138 is mounted on the shell 103 in the hollow 127. The integrated or combination connector 138 is partitioned between a center air conduit 161 mounted inside an annular water supply conduit 163. The connector 138 is connected to appropriate water and air distribution systems 131, 139. The canister 127 includes a water/air port 136 that provides the appropriate union with the water/air connector 138. The connector/port combination may also include appropriate locking structures to lock the union or the connector and the port. In this embodiment, both the water and air supplies for the jets are supplied with one connector system, which may simplify installation and removal.

As indicated above, the water connector is placed at any suitable location in the hollow. It is of any suitable construction. When the canister is not installed it is preferred that the water connector not be pressurized. An embodiment of the invention is a system that allows the spa water supply and installed canisters to be pressurized, while at the same time connectors in empty hollows are closed to water flow. This may be accomplished by a valve for each connector that is mounted in the hollow, behind the hollow, or elsewhere in the spa. The water connector may also incorporate an automatic valve that closes the connector when the canister is removed. Among such connectors are so-called quick connect valve connections, which open the valve when the canister water port is pushed onto the water connector, and closes the valve when the canister is removed and the union between the water connector and the water port is broken.

Figure 15:
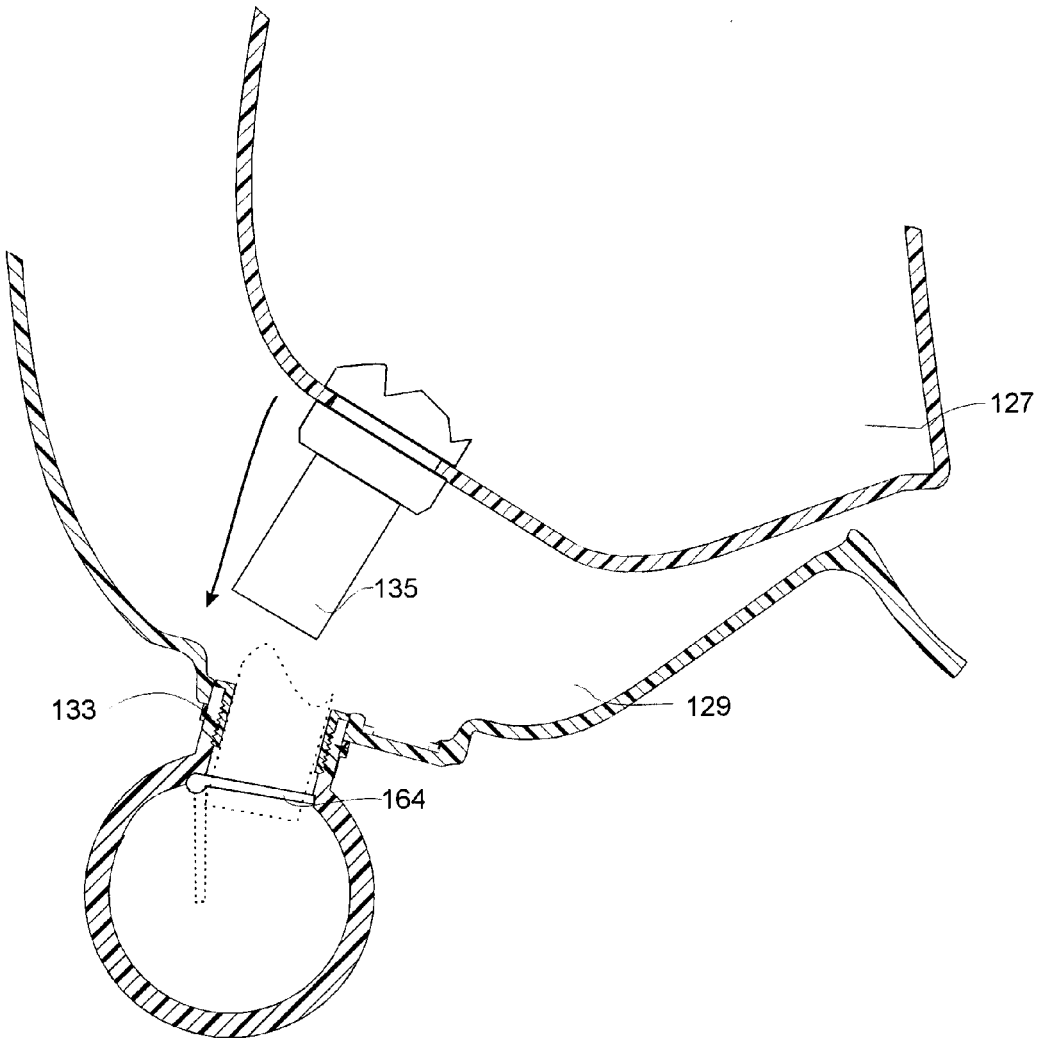
FIG. 15 is a cross-sectional view of a portion of a canister and hollow showing an example quick-connect water connector and water port assembly.

Reference is now made to FIG. 15, wherein is shown a detail of a quick connect/disconnect valve as a water connector/port assembly. The canister 127 has a water port 135 structured to be snapped into the water connection 133 structure in the hollow 129. The port is structured to open the flap valve 164 (shown in phantom in the open position) to allow water to pass through the connector/port union into the canister. When the canister is removed, a pulling force separates the connector and port, which allows the flap to close under water pressure and prevent water flow.

Basically, a connection configuration is suitable that allows the canister port to be reversibly removable from the connector, and also provides a pressurized water connection between the water supply system and the interior of the canister when the canister is installed.

The air supply connection in the hollow may be at any suitable location. For atmospheric or non-pressurized air supply systems the seal and valving requirements are not the same as for the water connection, because the system is not always pressurized. For these non-pressurized systems, any system that allows establishment of an air conduit from an air inlet on the spa to the interior of the canister when the canister is installed is suitable. In FIG. 6 is shown an air connector 141 in the hollow near the top connected with an air supply system 139. The air supply system comprises an air manifold or input structure 168 under the pillow or top rail of the shell. The air input may be essentially an opening in the shell that opens to the atmosphere, by means of a plenum or baffled opening in the shell. Any associated filters, liquid water removers, and the like, may be placed in an air supply manifold under the shell, or be contained in the canister. Any air input opening to the atmosphere is preferably protected by a baffle, for aesthetic reasons and to prevent foreign debris from entering the air supply. However, an opening in the top rail to a chamber under the top rail that communicates with the air connector is also contemplated by the present invention. In addition, a single air inlet with an air distribution system providing air to each air connector in the hollows is also contemplated. The air port should also be reversibly removable from the air connector, as defined above. Basically for non-pressurized systems, any construction that brings the air connector in the hollow in registration with the air port on the canister is contemplated. For pressurized air supply systems 139, systems comprising appropriate seals, air compressors, pressure tanks, and the like are contemplated.

The water and air connectors, and their matching water and air ports may incorporate suitable locking structures to secure the water and air passages into the canister and/or to assist in securing the canister in the hollow. This may include, for example, locking annular rings, spring loaded pins and apertures.

The outer dimensions of the canister need correspond with the dimensions of the hollow only to the extent that the water and air connections in the hollow can come in registration or connection with the water and air ports of the canister and form suitable air and water conduits. There may be significant spaces between the shell wall of the hollow and the outer surface of the canister, or alternately the canister may be configured to closely fit into the hollow. For appearance and comfort reasons, the jet plate of the canister should also preferably fit sufficiently close into the periphery of the hollow to provide a suitable continuous surface in the containment.

A spa is preferably constructed with more than one of its stations having the same hollow and port construction, so that the canisters can be switched and interchanged freely. Optionally, where different jet stations are required at certain stations in a spa, different canisters configurations for these stations may be designed to contemplate these differences. For example, there may be separate canister/hollow configurations and standards for corner seat stations, side seat stations, reclining stations, leg jet stations, and foot jet stations. Jet stations may also be provided with shower jets, or other appropriate above-water line water injection.

Optionally, some canisters may have jets that do not require an air supply, so an air connector for some station where such canisters are placed is optional. However, it is preferred that all reclining stations have an air connector so that canisters of any jet configuration can be used in all of the stations to allow for complete interchangeability. For example, A hollow with both air and water connectors can be used for a canister requiring no air supply with only a water port. Preferably, a hollow should be constructed such that there is complete interchangeability between canisters, regardless of air or water requirements of the canisters.

It is contemplated that canisters be made interchangeable, and that the canisters be made with various jet configurations. For example, to change a jet configuration in a jet station, the canister can be simply removed, and a canister dimensionally and port compatible with the same hollow is inserted in its place. The only basic requirement for a canister to be interchangeable is that it has suitable dimensions and port construction and placement to be installed in a hollow of a predefined standard.

Examples of Internal Construction of Canister

Once that a standard for hollow configuration is established, with standards for water and air connector configuration and placement, the canister can be constructed with any suitable construction that conveys waters and air respectively from the water and air port to the jets on the canister jet plate.

The canister may be constructed of any suitable material by any suitable method. Basically, the requirement of the internal structure is that there be a jet water distribution system that conveys water from the water port to the water inlet of the jet. Likewise, a jet air distribution system must convey air from the air port of the canister to an air inlet of the jet. Any suitable construction that meets this requirement is contemplated by the invention.

A canister design can be made to use conventional jets that are readily available on the market, or customize jets for a particular canister construction. The jets can be mounted or installed in the jet plate of the canister by any suitable method, e.g., by drilling the canister shell and gluing in the jet, or molding the jet directly into the jet plate when the canister is formed. In the figures, the jets may be shown schematically, for it is understood that the present invention is not limited to any jet construction, and any suitable configuration can be used.

The canister may be molded from the same material as the shell, or made, for example by molding a compatible polymer material. Other materials, as required for the function of the canister, may be used, such as metal inserts for locking rings, fasteners, reinforcement stays, and springs. The canister may be made as one piece, or fabricated from a plurality of pieces. As shown below, the jet plate upon which the jets are mounted may be removable and accordingly may be made of the same or different material than the rest of the body of the canister.

In the examples described, a canister for a back reclining jet station is usually described. However, these constructions can be adapted for canisters for other jet stations, such as neck massage, leg rest and massage, foot massage, shower massage, etc.

In addition, similar designs can be used for conveying different fluids. For example, a system for conveying air can be adapted for water. The air supply and water systems can with some adaptation be interchanged. In addition, instead of a canister for air and water, a similar dual supply canister for low pressure water and high pressure water can be constructed. In addition, a third fluid system (or more) can be added, for example, a canister with three chambers for high and low pressure water and air for a jet station with high pressure water/air jets, low pressure water/air jets. The canisters of the invention, can be adapted for any fluid, but include preferably water, (under any pressure), and air (unpressurized or under any pressure)

In FIG. 1, is schematically shown a canister 127 with a jet water distribution system 131 and a jet air distribution system 145 of branching water and air lines 165, 167 to provide separate lines to each jet 119. An advantage of this system is that conventional jets can be used with the various water and air lines connected to existing water and air connectors on each jet. A disadvantage of this system is the complexity introduced by the multiple branched system of tubes with accompanying branched fittings or manifolds, with a system for both the water and air distribution. However, even with this system, an installer or repairer is not required to disconnect or connect all of these tubes and fittings, as the entire canister is installed and replaced.

Figure 16:
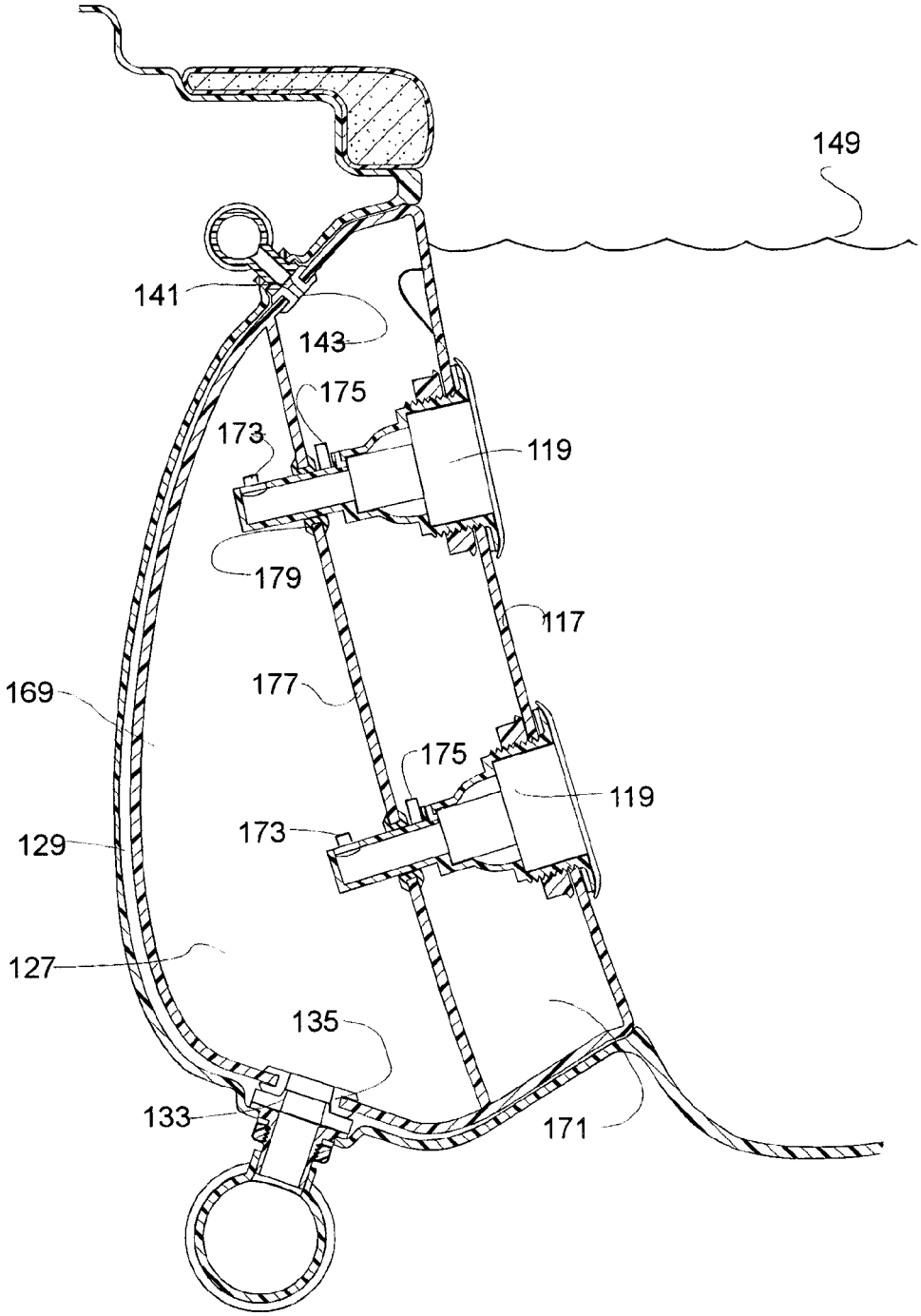
FIG. 16 is a cross-section of a canister and also showing the canister in a hollow.

In FIG. 16, is shown a canister 127 with a jet water distribution system and a jet air distribution system that eliminates the branched system in FIG. 1. In this system, the interior of the canister 127 is partitioned by partition 177 between a water chamber 169 and an air chamber 171. The water chamber 169 communicates with the water port 135 of the canister 127 and the air chamber 171 communicates with the air port 143. The jet 119 extends from the jet plate 117 through the air chamber 171, through the partition 177 and into the water chamber 169. Accordingly, the jet extends into both chambers such that the jet water inlet 173 is in the water chamber 169 and the jet air inlet 175 is in the air chamber 171. Any such partitioned construction is suitable. The partitioned canister simplifies construction and reduces manufacturing cost of the canister.

In the example in FIG. 16, the jet 119 is mounted on the jet plate 117 and extends through the air chamber 171. It then penetrates the partition 177 between the water and air chambers 169, 171 to extend into the water chamber 169. An advantage of this embodiment is that it can be used with conventional jets. Any hose attachments at the water and air jet inlets are unused as attachments and function only as respective water and air inlets 173, 175 into the jet. All of the jets in the canister 127 are mounted such that each is supplied from the common water chamber 169 that communicates directly to the water port 135. Likewise a single common air chamber 169 communicating with the air port 143 provides an air supply for all of the jets 119. Illustrated are two jets, but the same concept can be used to supply several jets, as many as desired by the spa designer.

In FIG. 16 the jets are mounted on a jet plate 117 that is generally parallel to the partition. This is so that a canister can be first manufactured without jets, and the jets later installed at any location on the jet plate. To make a custom jet pattern or configuration on the jet plate, the jet plate and partition are drilled at each jet location where the jet is mounted. The constant distance is such and within sufficient tolerance to place the partition between the water port and the air port of the jet-plate-mounted jet. Accordingly, when the jet is installed, with appropriate seals 179 in the partition and the jet plate, the installed jet is appropriately supplied with both air and water. Any number of jets can be installed as long as there is room on the jet plate, and jets can be installed at any location on the jet plate. The jets shown are of generally conventional configuration with water and air connectors functioning as water and air ports.

FIG. 13 also shows how a canister 127 fits into a hollow 129, and how the water and air passages from the water and air connectors 133, 141 in the hollow 129 to the jets are in relationship to the hollow.

Figure 17:
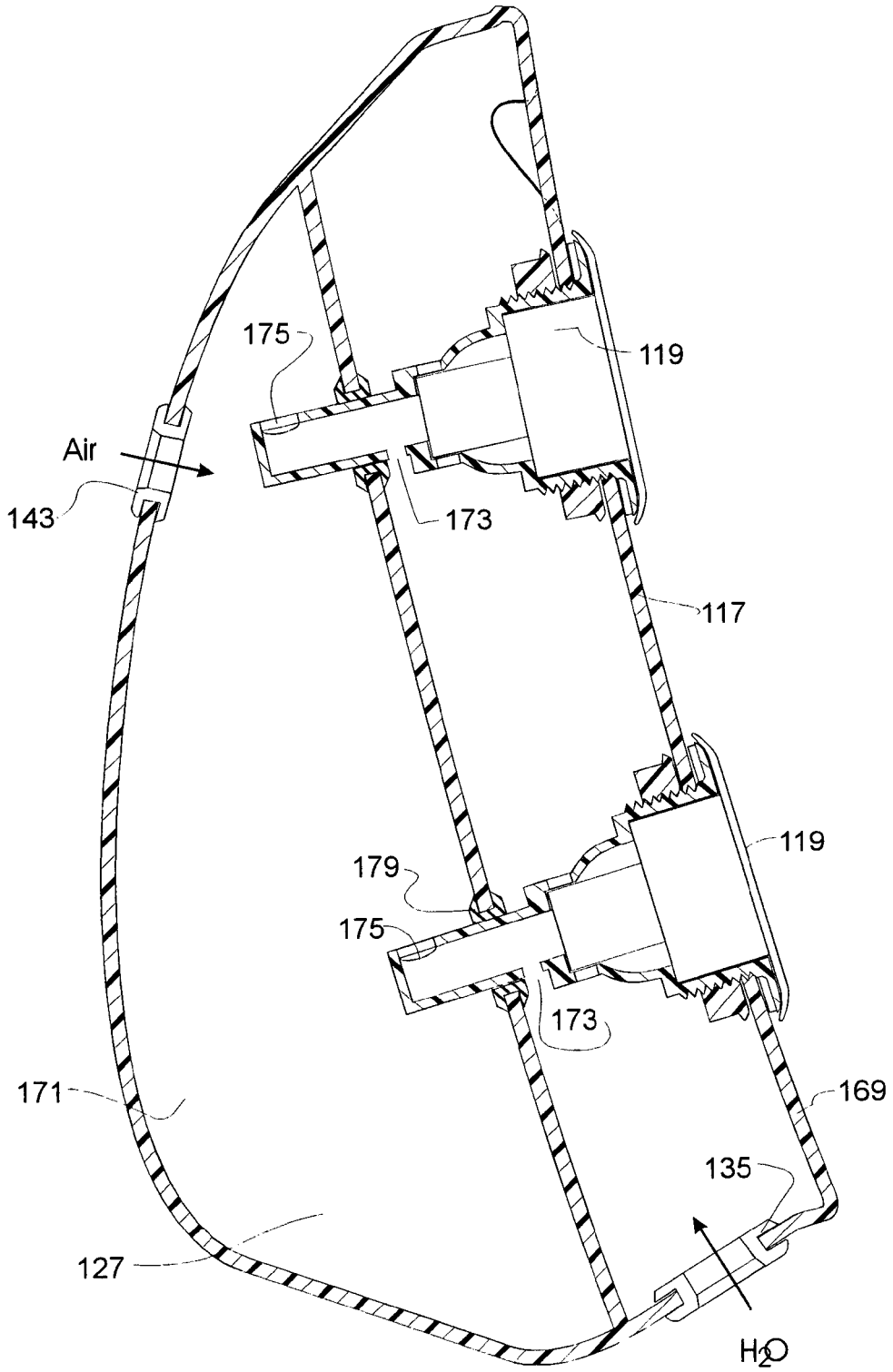
FIG. 17 is a cross-section of an alternate canister construction.

Another partitioned canister 127 of the invention is shown in FIG. 17. This embodiment differs from that in FIG. 16 in that chambers are reversed in position. The water chamber 169 is between the jet plate 117 and the air chamber 171, rather than the air chamber between the jet plate and the water chamber as in FIG. 16. The water port 135 and the air port 143 are disposed differently to communicate with the water chamber 169 and air chamber 171, respectively. Jets 119 are mounted on the jet plate 117 and extend through the water chamber 169, then through the partition 177 into the air chamber 171. The jets 119 are constructed with a jet water inlet 173 in communication with the water chamber 169, and a jet air inlet 175 in communication with the air chamber 171. The jets can be installed in a similar manner as in FIG. 16. Alternately, in either embodiment, the jets, or at least a jet mounting structure can be molded into the jet plate when the canister is first formed. An advantage of this embodiment is that the jets act as stays or ties in the pressurized water chamber and resist the tendency of the water chamber to expand or inflate under pressure of the water in the chamber.

Figure 18:
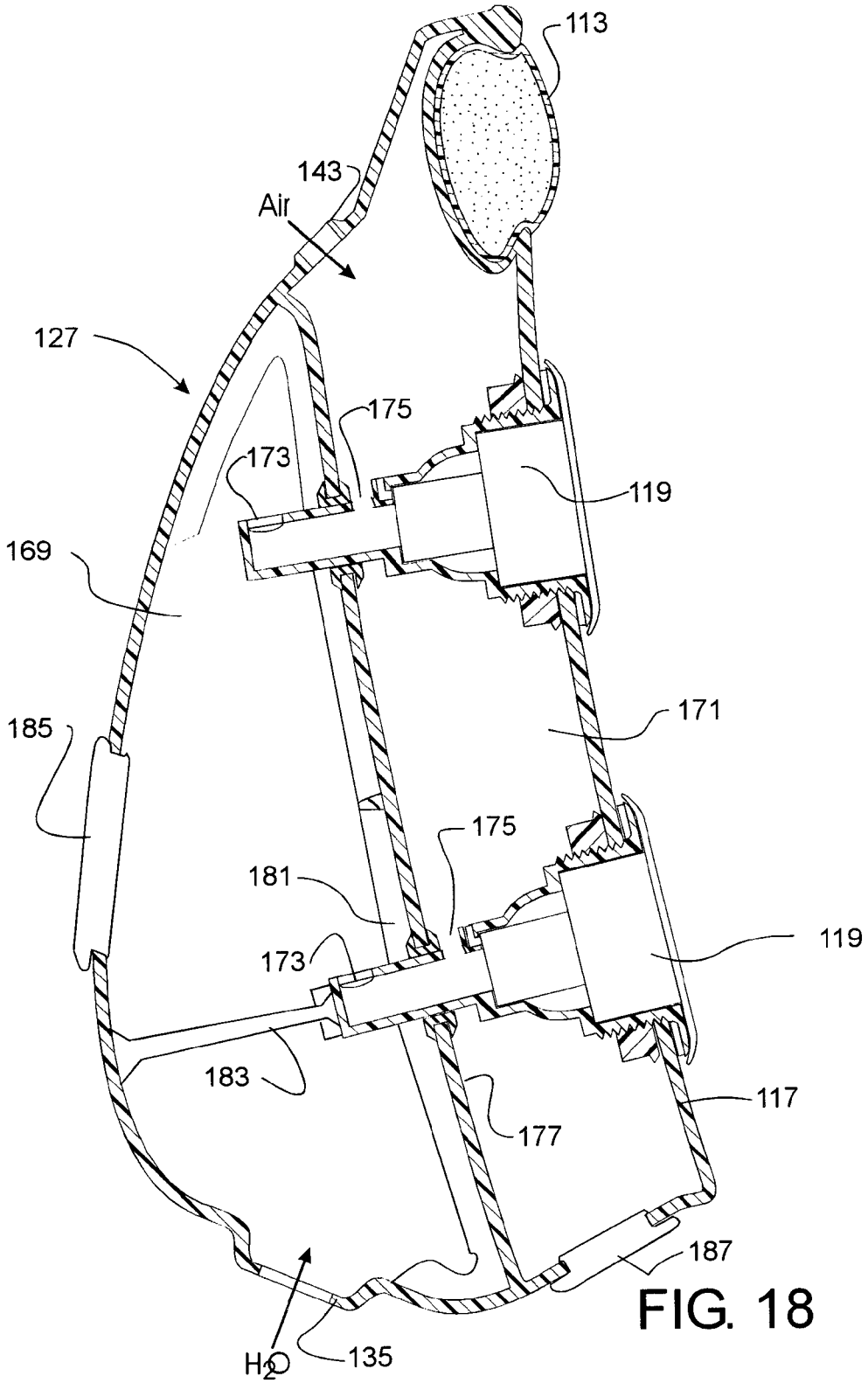
FIG. 18 is a cross-section of another alternate canister construction.

Reference is now made to FIG. 18, which shows another canister 127 of the invention. This embodiment is similar to the two chambered canister of FIG. 16 where an air chamber 171 is disposed between a water chamber 169 and a jet plate 117. The jets 119 mounted on the jet plate 117 extend through the air chamber 171, a partition 177 between the air and water chamber and into the water chamber 169. A water inlet 173 and an air inlet 175 for the jet are disposed respectively in the water and air chambers 169, 171. A water port 135 communicates with the water chamber 169 and an air port 143 communicates with the air chamber 171. In this embodiment a head-rest 113 is incorporated into the canister. In addition, to resist inflation of the water chamber by water pressure the partition 177 and walls of the canister 127 include stiffening ribs 181. In addition, there is a tie 183 that extends from the end of a nozzle 119 to the back wall of the water chamber that also resists inflation. Also shown are a water chamber access port 185 and an air chamber access port 187 that may be removed to gain access to the interior of the water and air chambers, respectively. These may be desired for cleaning, maintenance and repair of the canister.

Figure 19A:
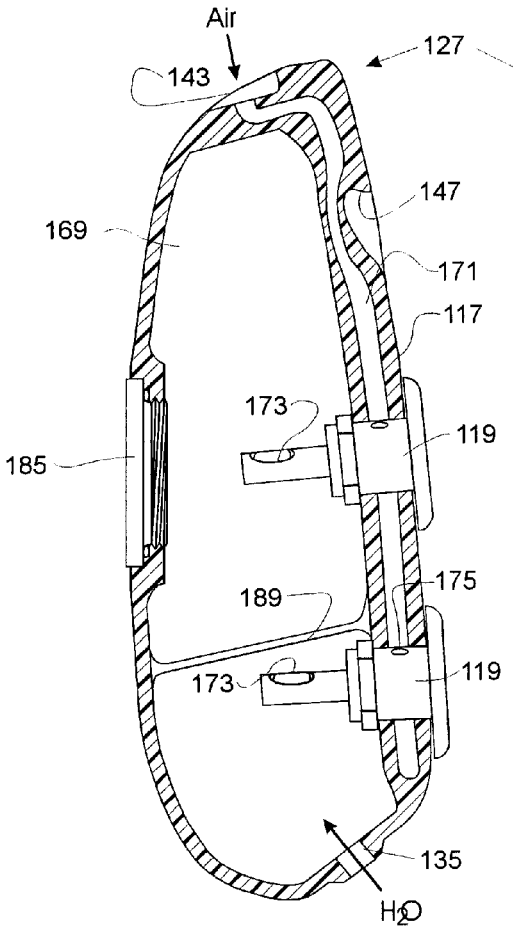
FIGS. 19*a* and 19*b* are respectively a cross-section of another alternate canister construction, and a view of the jet plate.
Figure 19B:
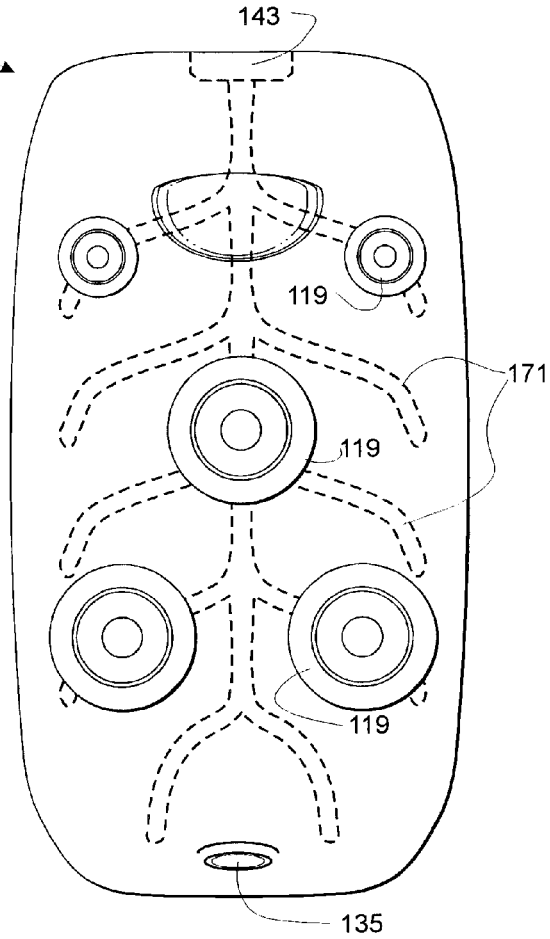

Reference is now made to FIGS. 19A and 19B, which show another two chambered canister 127 of the invention. In this embodiment, an air chamber 171 is reduced to a branched conduit system between a partition 177 and a jet plate 117. Jets 119 are mounted at any point where branches or conduits of the air chamber 171 run under the jet plate 117, so as to provide the air supply for the jet. The jets 119 extend through the air conduit/chamber 171 and the partition 177, and into the water chamber 169. The branched air chamber originates at an air port 143, and a water port 135 communicates with the water chamber 169. A water inlet 173 and an air inlet 175 for the jet are disposed respectively in the water and air chambers 169, 171. Also shown is a tie 189 between the partition and the back of the water chamber to resist water chamber inflation from water pressure. A water chamber access port 185 is provided to gain access to the water chamber 169, and a handle 147 is molded into the canister to ease installation and removal of the canister.

Figure 20:
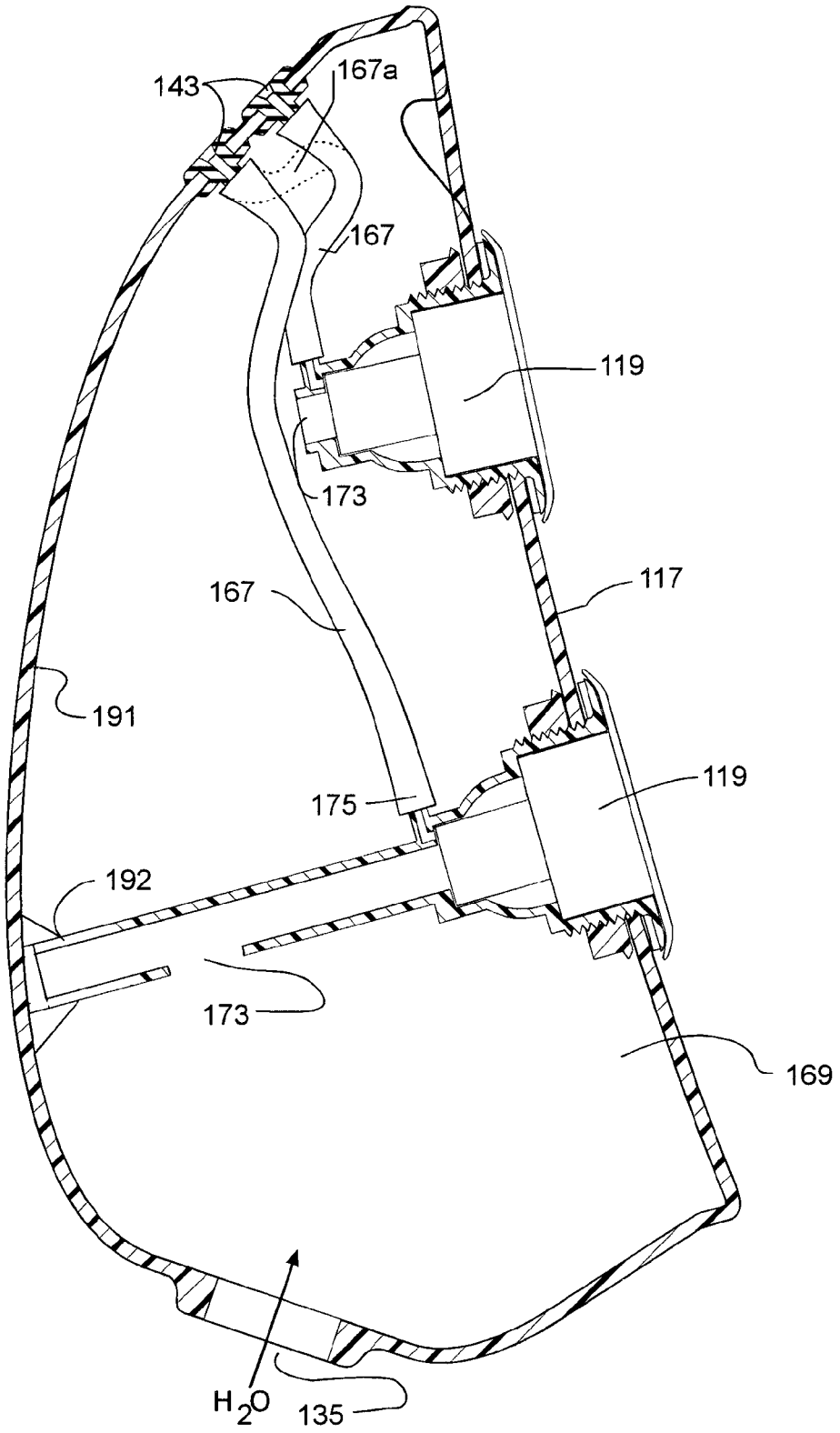
FIG. 20 is a cross-section of another canister construction.

Reference is now made to FIG. 20, which shows another embodiment of the invention. This embodiment shows a canister 127 with a chambered construction wherein there is a water chamber 169 from which the jets 119 mounted on a jet plate 117 are supplied with water through water inlets 173 on the jets. A water port 135 communicates with the water chamber 169. The air is supplied through air supply lines 167 that lead from respective air ports 143 to the jet air inlets 175. Here two air ports 143 are shown, but there may be one air port supplying all the jets 119, as shown by the phantom air supply line 167*a*. In this embodiment, a rear portion 192 of a jet extends to the back wall of the canister in the water chamber where it is attached, by for example a weld or threaded fitting. This is intended to inhibit inflation of the water chamber under the pressure of the water in the chamber.

Figure 21:
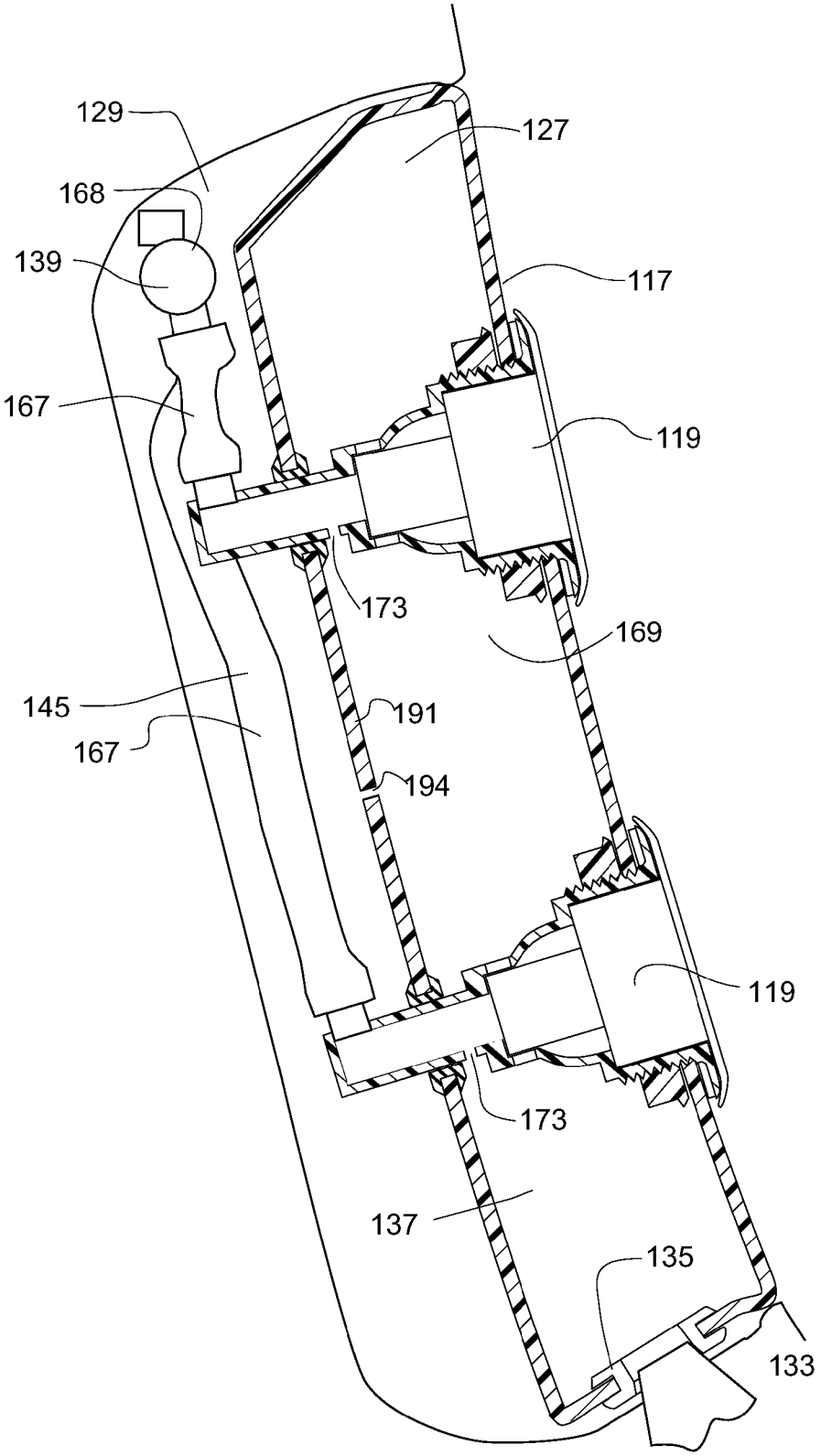
FIG. 21 is a cross-section of yet another canister construction.

Reference is now made to FIG. 21, which shows another embodiment of the invention. This canister 127 comprises a water chamber 169 placed directly behind a jet plate 117 upon which jets 119 are mounted, with a water port 135 communicating with the water chamber 169 for a water supply. The water chamber 169 has a back wall 191 that is generally equidistant from the jet plate so that when a jet 119 is mounted on the jet plate 117 it extends through the water chamber, through the back wall 191, and behind the back wall. The water inlets 173 of the jets 119 are positioned in the water chamber with the air inlets positioned behind the back wall. Air is supplied through air lines 167 that extend from the air inlets of the jets up behind the back wall to an air manifold/inlet air supply 139 placed above the water line (preferably with releasable connections for the air lines 167). Alternately, the air lines may lead to an air port structure for connection to an air connector in the hollow. To provide space for the air lines, the rear wall does not conform to the shape of the hollow 129. To insure circulation of water in any portion of the hollow, a small circulation hole or holes are in the wall of the canister 127 to circulate water from the pressurized water chamber 169.

Figure 22:
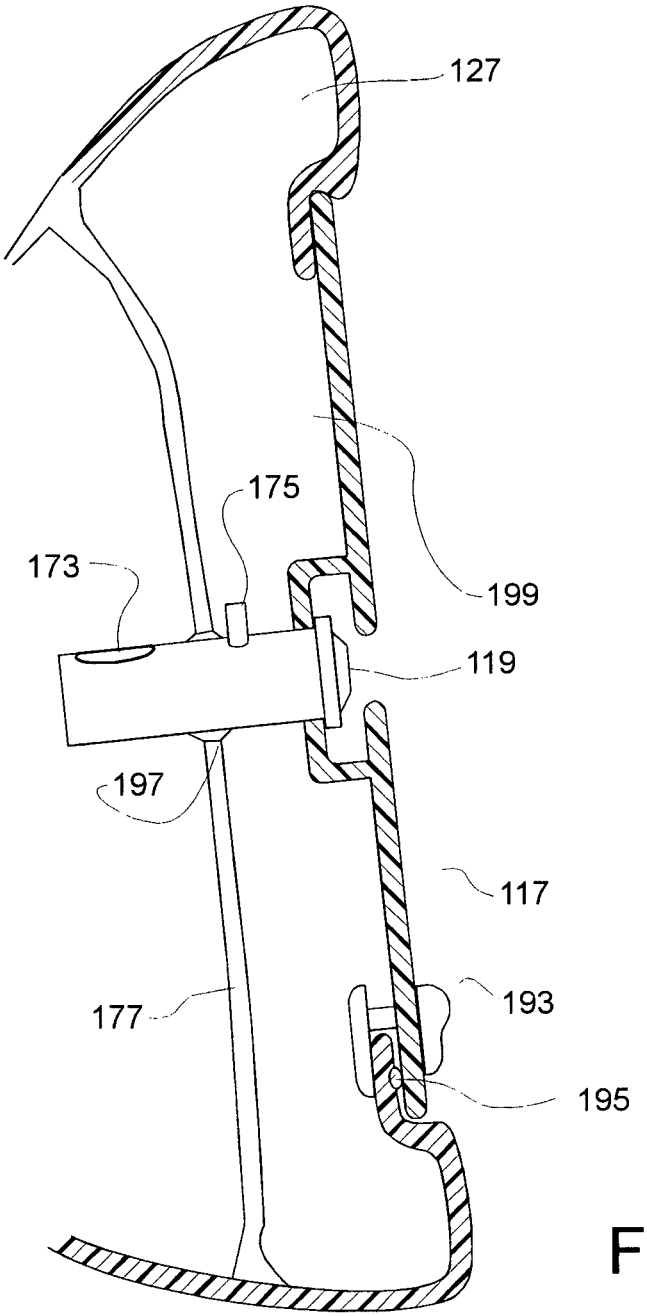
FIG. 22 is cross-section of a portion of a canister showing a removable jet plate.

Reference is now made to FIG. 22. As explained elsewhere, the canister can be manufactured as a unitary structure or assembled from several parts. In an embodiment of the invention, the jet plate 117 upon which the jets are mounted is built as a removable panel 118. This is a modification that can be made to any of the above illustrated embodiments. The advantage of a removable jet plate is that canister bodies can be built to a standard, and jet plates with various jet configurations can be built for installation on the standard canister. The jet plate with the desired configuration is installed on the canister, rather than having to install separate jets on the canister itself. In FIG. 22 is shown the canister 127 with a jet plate 117 and jets 119, and a suitable system for securing the jet plate to the canister body, such as latches 193, or the like, and suitable seals 195 between the jet plate and the canister body. In the embodiment shown in FIG. 19, the only alteration that may have to be made to the canister for installation of a jet is to provide for the separate water and air supply for the water and air inlets 173, 175 of the jet. This is done by drilling a hole in the partition for passage of the jet body, and adding a suitable partition seal 197 in the hole, as shown. An advantage of this system includes more flexibility in upgrading, replacing, and repairing the jets. Another advantage is that it is simpler to manufacture customized jets with this system as they can easily be molded directly into the jet plate.

Figure 23:
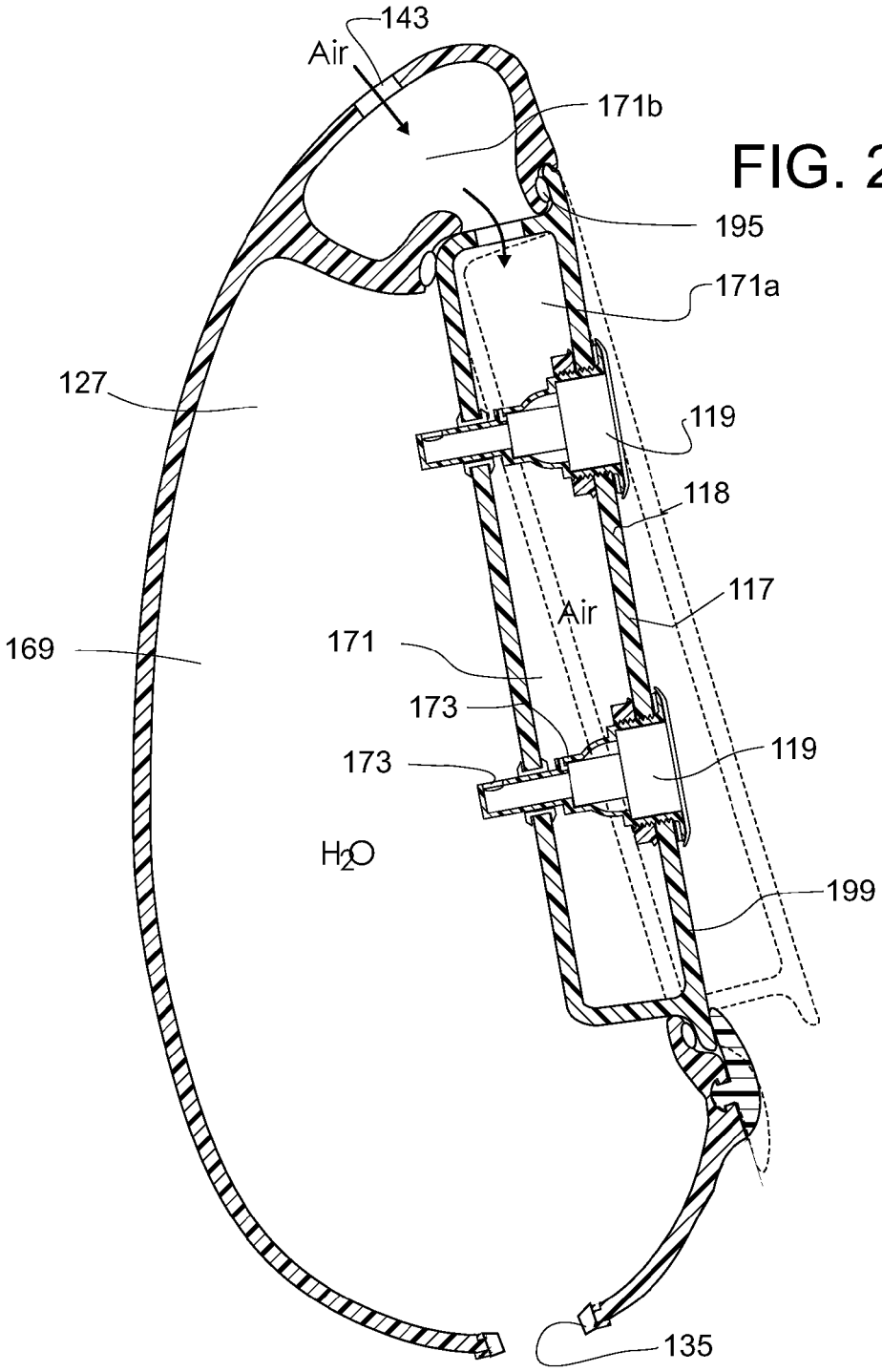
FIG. 23 is a cross-section of an alternate canister construction with a removable jet plate.

Reference is now made to FIG. 23, which shows a canister 127 with a removable jet plate 117. In this embodiment, the canister 127 has a jet plate 117 and a portion of the air chamber manufactured as a removable unit 199. The air chamber 171 includes a portion 171*a* in the removable unit 199 that communicates with a portion 171*b* in the canister body, which in turn communicates with the air port 143. The jets are mounted in the removable unit with the jet air inlets 175 in the removable unit air chamber 171*a*, and the water inlets 173 of the jet are disposed on a portion of the jet extending out of the back wall of the removable unit into the water chamber 169. The water chamber in turn communicates with the water port 135. An advantage of this system is that no alterations need be made to the canister body when installing or replacing the removable unit. This system can be applied to any suitable chambered design by incorporating a portion of a water chamber or an air chamber into a removable unit.

Reference is now made to FIG. 24, which shows a canister with a water chamber in the hollow, and no water chamber in the canister. An assembly of the jet plate 117 with jets 119, and the air chamber 171 is made as a removable canister 127. The jets 119 extend from the jet plate 117 through the air chamber and out through the rear of the canister. The air inlet 175 for the jet s119 is located in the air chamber. There is no water chamber in the canister, but the space 198 behind the canister functions as a water source for the water inlets 173 of the jet 119. This demonstrates how spaces in or near the hollow of the shell can be used as a portion of the structure to convey water from a water supply 131 system to the jets 119. In a like manner spaces in or near the hollow can be used or transport air from an air supply.

Figure 25:
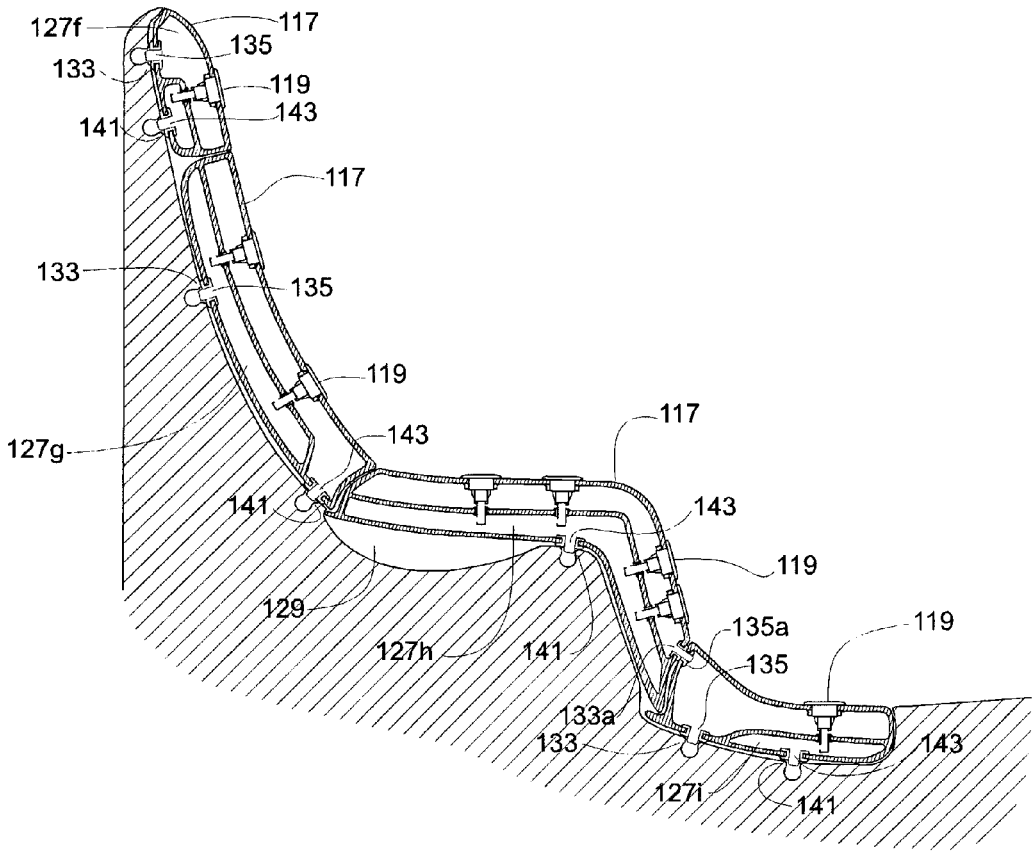
FIG. 25 is a schematic of a segmented or subdivided canister design.

Reference is now made to FIG. 25, which shows segmented canister systems, similar to that shown as 127*a*, 127*b*, and 127*c* in FIG. 3. In FIG. 25 a jet station comprises a neck massage canister 127*f*, a back support canister 127*g*, a leg message and support canister 127*h*, and a foot message canister 127*i*. Each of these canisters can be built by adapting to the required dimensions and shape. The construction of each canister includes a jet plate 117, jets 119, and ports 135, 143 for water and air corresponding with connectors 133, 141 in the hollow 129. Since the canisters are adjacent to one another, a water or air connector can be disposed for supply from an adjacent canister. This is shown in between canisters 127*h* and 127*i* where water is supplied to canister 127*i* through a water connector 133*a* on canister 127*i* and a water port 135*a* on canister 127*h*. This example also shows canisters with a the dual chambered design and illustrates how such chambered designs can be adapted for various functions.

Figure 26:
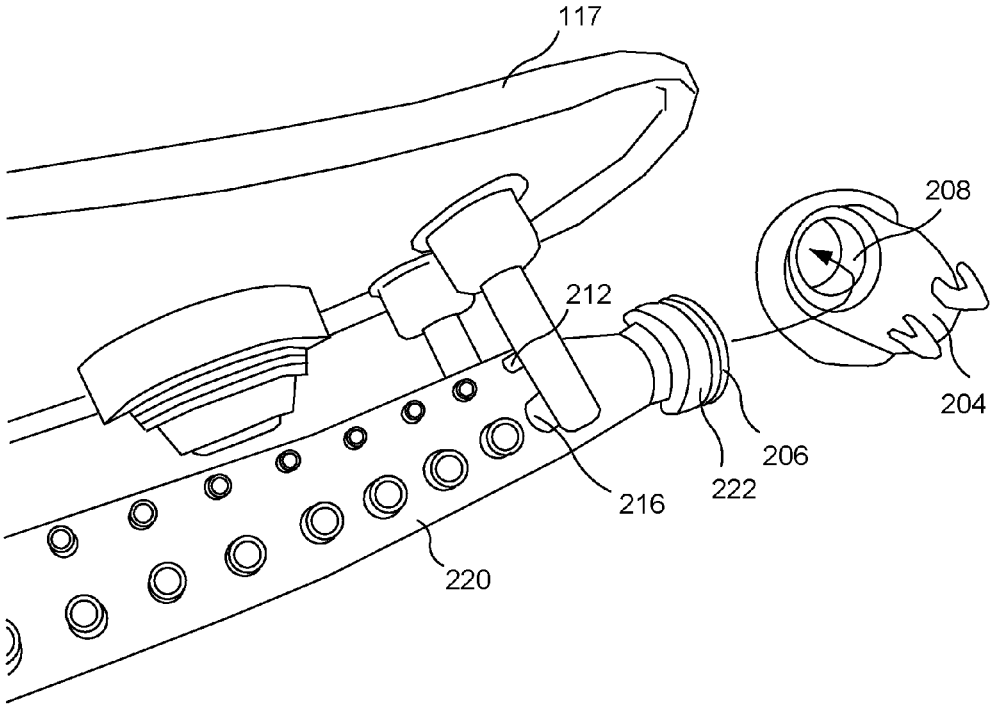
FIG. 26 is a perspective view of a jet pack system that includes a secure feature.

Reference is now made to FIG. 26, which shows a jet pack system that includes a secure feature 204. The jet pack system can include the preceding embodiments described herein, for example, embodiments that include the canister 127 and jet plate 117. Other embodiments that may be used as a jet pack system are also anticipated as being included in the foregoing description.

The jet pack system in FIG. 26 is shown in an unsecured state. Embodiments of the secure feature 204 may include a hook, clasp, latch, rivet, or other type of secure piece. The example shown includes two hooks that may be engaged to members of a main conduit 220. Such members may include an air conduit 212 and a water conduit 216 located on the side of a main conduit 220. The secure feature 204 may be engaged to the air conduit 212 or the water conduit 216, or both conduits 212 and 216. Although not visible from the viewpoint of the drawing, a corresponding air conduit and water conduit may be located on the other side of the main conduit 220. As such, the secure feature 204 may also be engaged to one or both of the conduits on the other side of the main conduit 220. For example, one hook of the secure feature 204 may be engaged with the water conduit 216 and the remaining hook may be engaged with the water conduit on the opposite side of the main conduit 220.

In certain embodiments, only one water or air conduit diametrically opposed on the sides of the main conduit 220 may be engaged with the secure feature 204. On the other hand, there may be multiple conduits that may be engaged with the secure feature 204. Also, there may be only one conduit or multiple conduits on only one side of the main conduit that may be engaged. The conduits may carry both water and air. Alternatively, in place of conduits there may be a hollow bar, filled bar, or other end piece that may be engaged with the secure feature 204.

The secure feature 204 as shown is attached to the bottomfeed 208, however, it may be attached to the jet plate 117, canister 127, the main conduit 220, or any other member of the jet pack system to reversibly secure the jet pack system to the bottomfeed 208.

In order to secure the jet pack system, a simple manual installation or a simple tool installation may be necessary. The main conduit 220 may slidably engage with the bottomfeed 208. Also, a port ring 206 may be slideably disposed on the main conduit 220 and rest against a casing 222 on the main conduit 220. When the end of the main conduit 220 and the port ring 206 are positioned on the opening of the bottomfeed, the secure feature 204 is pulled back to conform to and engage with the desired member of the main conduit 220. This assembly is advantageous because it is simple and efficient for both professional workers and homeowners. In certain embodiments, however, certain simple tools may be required to achieve the secure state.

Figure 27:
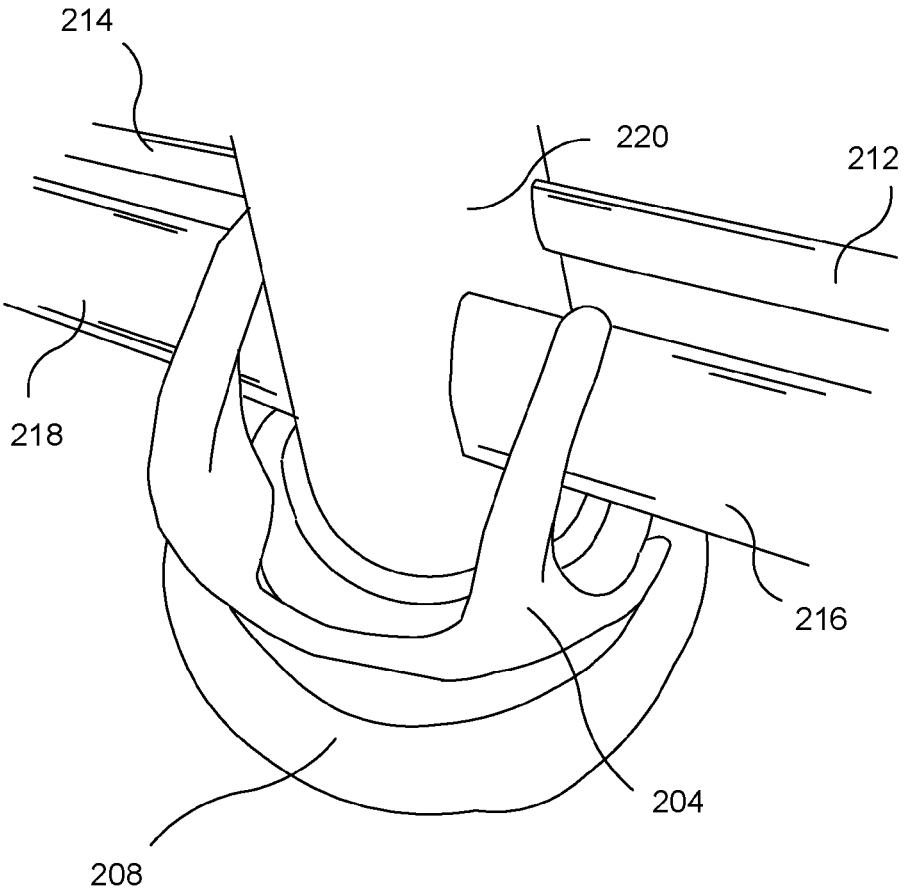
FIG. 27 is a perspective view of the jet pack system attached to the secure feature.

Reference is now made to FIG. 27, which shows the secured state of the jet pack system. In the secured state, the secure feature 204 is engaged with a member on the main conduit 220. As shown, the secure feature 204 is wrapped around water conduits 216 and 218, which are located on either side of the main conduit 220 and which allow water or other fluids to pass through to the interior of the main conduit 220. Alternatively, the secure feature 204 may wrap around both air conduits 212 and 214 and water conduits 216 and 218, only one conduit on one side of the main conduit. Like the water conduits 216 and 218, the air conduits 212 and 214 are located on either side of the main conduit 220, however, the air conduits 212 and 214 allow air instead of fluid to pass through to the main conduit 220. Other arrangements are possible. For example, the secure feature may be connected with or otherwise stem from the main conduit 220 or a member adjoined to the main conduit 220 and be engaged with a member of the bottomfeed 208. Thus, the engagement is reversed. Furthermore, the secure feature 204 may include a spring or additional secure features to enhance the ease and security of the connection.

In the secured state, pressure exerted against the main conduit 220 and thus the entire jet pack system may be counterbalanced in an equal and opposite direction by the secure feature 204 when the main conduit 220 and the bottomfeed 208 are engaged. The pressure exerted may arise from water and air traveling in the main conduit or other conduits. Alternatively or in conjunction with conduit pressure, pressure may include pressures not exerted in conduits.

Figure 28:
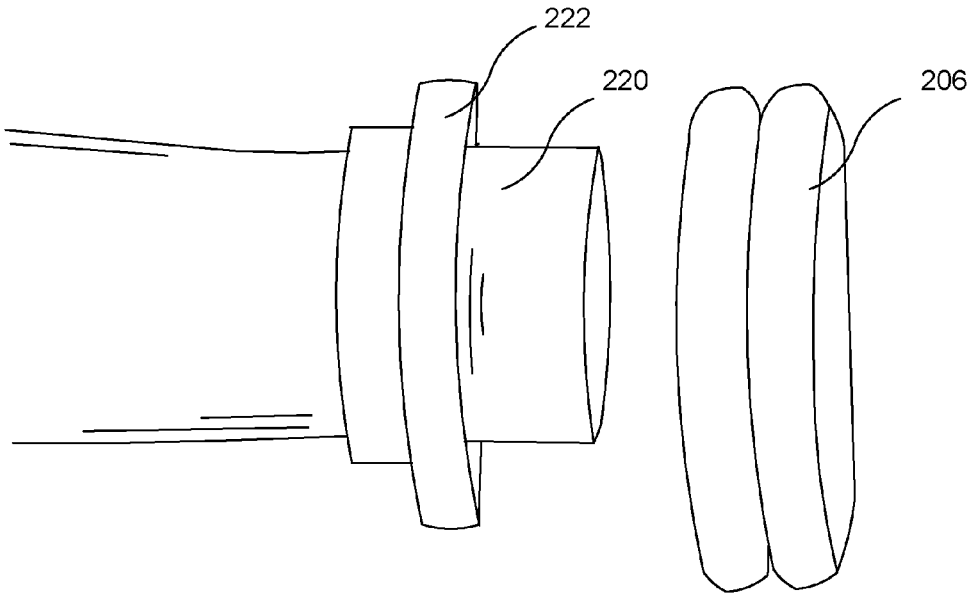
FIG. 28 is a perspective view showing\ the port ring, main conduit, and casing.

Reference is now made to FIG. 28, which shows the port ring 206, the main conduit 220, and the casing 222. To further a secure fit, the port ring 206 may include two rubber o-rings connected together. Alternatively, additional o-rings, only one rubber o-ring, or other variations known in the art may be used. The port ring 206 may fit on the end of the main conduit 220 such that it may be pressed between the casing 222 and the interior surface of the bottomfeed 208 when the bottomfeed 208 and the main conduit 220 are engaged. The advantage of the port ring 206 is that it protects against movement of the main conduit 220 away from the bottomfeed 208. Also, the port ring 206 provides a more leakproof engagement between the bottomfeed 208, the secure feature 204, and the main conduit 220. Additionally, other benefits may be afforded.

Figure 29:
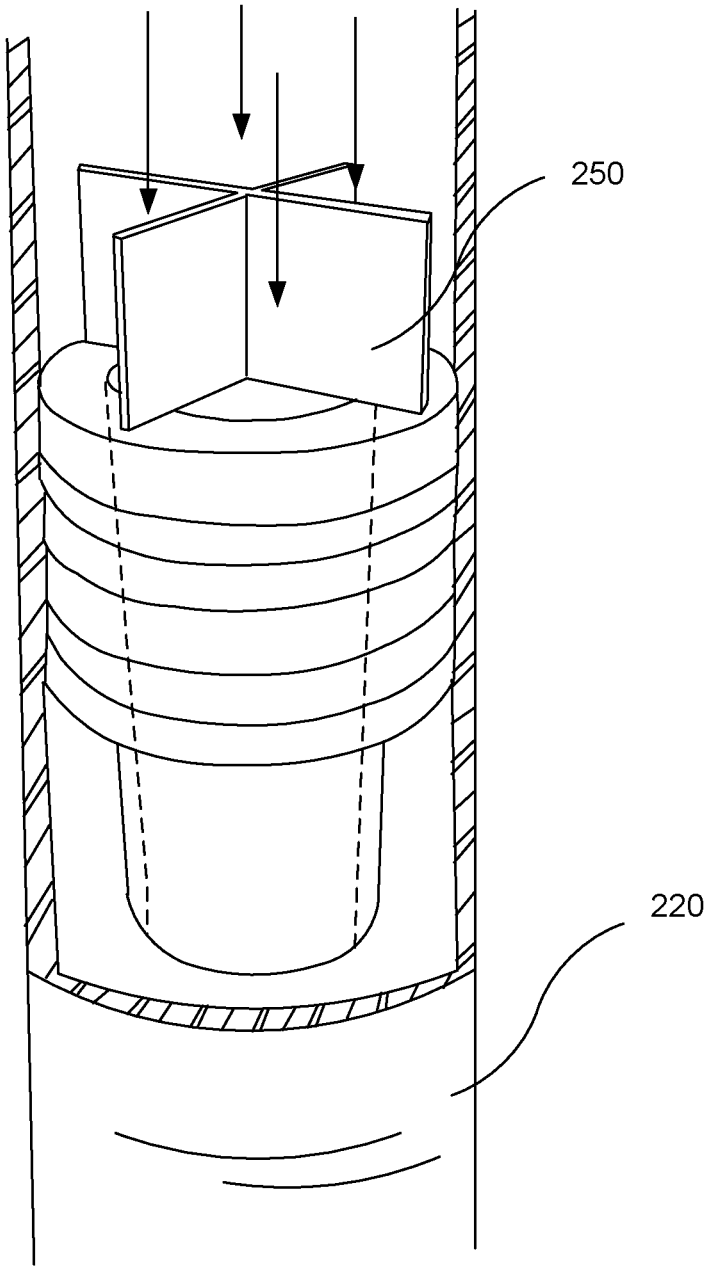
FIG. 29 is a perspective view of a flow regulator.

Reference is now made to FIG. 29, which shows a flow regulator 250. The flow regulator may include multiple fins that intersect. As shown, four fins intersect in a perpendicular manner, however the number of fins and their arrangement with each other may vary. The flow regulator 250 may be inserted in the main conduit 220 or its members such that air and fluid traveling through the main conduit 220 or its members passes through the space between the fins. Also, the flow regulator 250 may be located outside the main conduit 220 or its members. For example, the flow regulator may be placed inside the bottomfeed 208 or in the jet plate 117. The flow regulator 250 may be designed to control the flow of fluid or air, or both, and advantageously provides a means to break up turbulence and vortices, thus providing a more stable and laminar flow through the main conduit 220 and its members. Thus, the entire jet pack system benefits from the protection afforded by the flow regulator 250 against the instabilities and vibrations that otherwise occur as a result of flow problems at high pressures.

Figure 30:
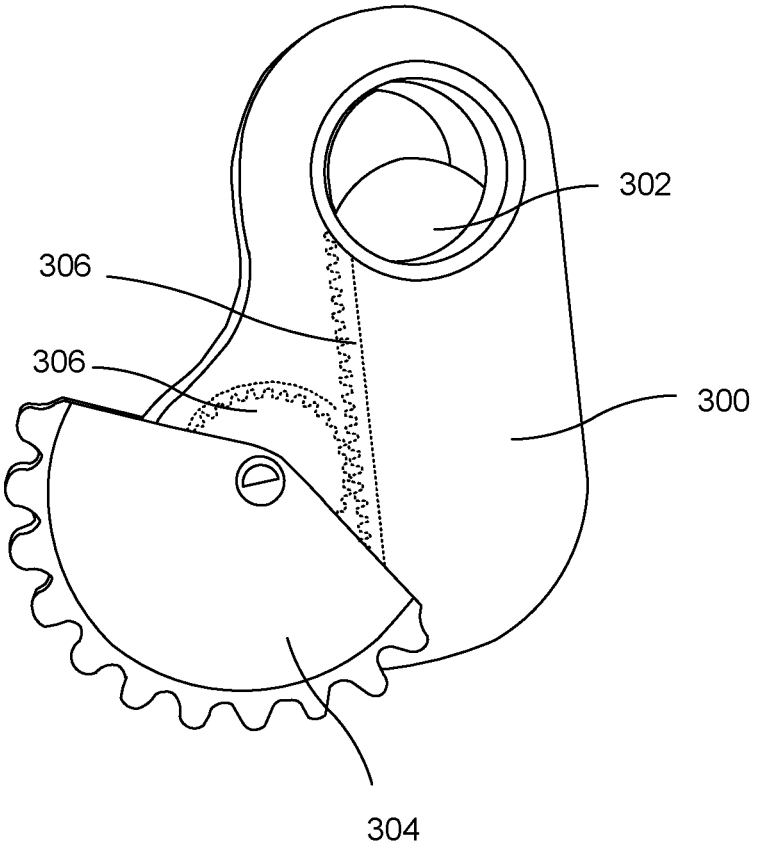
FIG. 30 is a perspective view of flow control.

Reference is now made to FIG. 30, which shows a flow control 300 and its components, components which may include a valve 302, a monitor wheel 304, and a rack and pinion 306. In certain embodiments, the flow control 300 may be attached to the main conduit 220 such that the valve 302 may restrict the flow of air and fluid depending on the size of the opening made by the valve 302. The size of the valve 302 opening may be controlled by the monitor wheel 304 and the rack and pinion 306. As the monitor wheel 304 is turned, either by manual or electronic direction, the rack and pinion 306 causes the valve 302 to open and close, and the flow increases or decreases, respectively. In certain embodiments, however, the rack and pinion 306 may be replaced with other gearing structures or other mechanisms that cause the valve to open and close. Other mechanisms may provide faster movement or more secure closure.

The flow control is beneficial because it allows the user to create a custom pressure exerted by the air and fluid in the jet pack system. For a spa environment that includes multiple jet pack systems, each user of a jet pack system or multiple jet pack systems may create a custom pressure to suit his or her individual taste. Also, the flow control 300 allows personally tailored adjustment during a given period of use. Subsequent uses may also be altered for changing desires or for tastes and needs of new users. Providing flow regulation eliminates necessity for taking apart the jet pack systems or taking time out of a particular spa use to find outside controls that adjust the pressures of all fluid and air to the spa. Flow regulation also eliminates the need to hire a professional to come and adjust the pressures.

Certain embodiments of the jet pack system may comprise more than one flow control 300. For example, each jet on a jet plate 117 may have its own flow control 300. In this manner, a user may isolate pressures in certain jets to be higher in certain regions of a jet plate 117 than in others, and thus create a unique spa experience tailored to that particular user. This may be advantageous for users with special needs, such as a user with a lower back injury that seeks to avoid pressure in the region of his lower back. Other pressure needs may be addressed with the incorporation of multiple flow controls 300.

Figure 31:
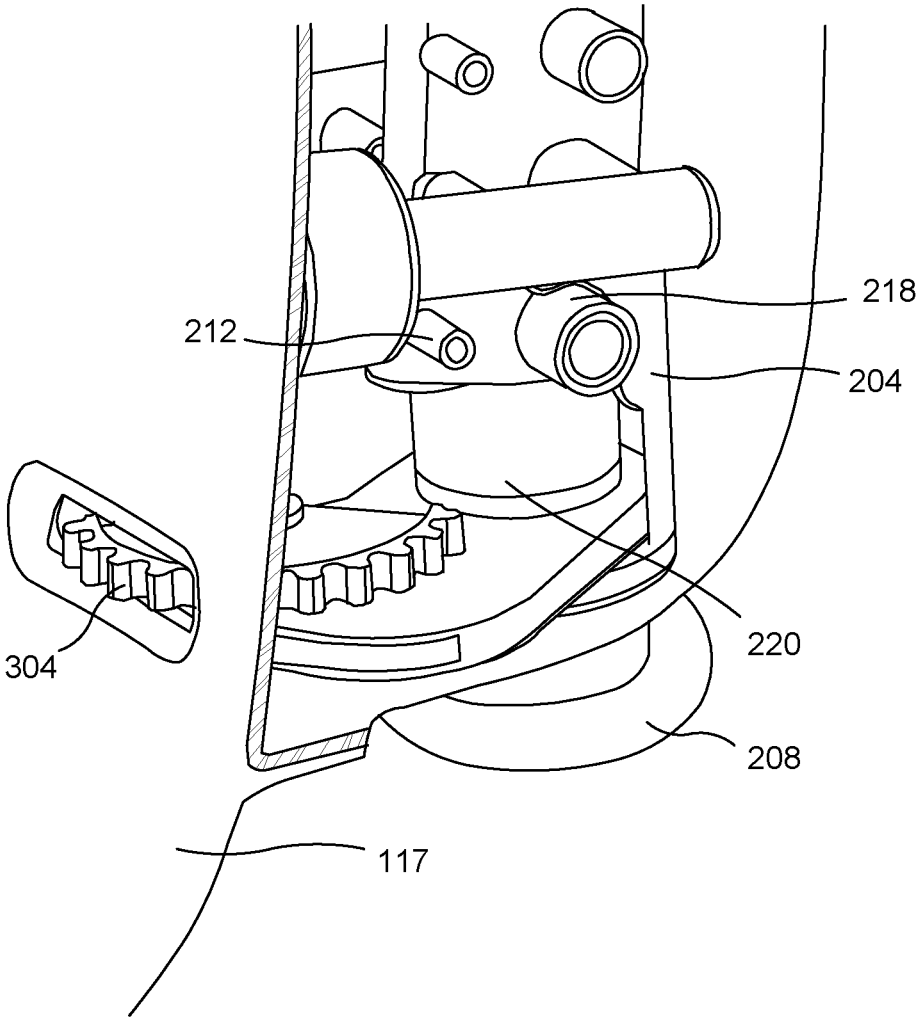
FIG. 31 is a perspective view of a monitor wheel of the flow control exposed on the outer face of the jet panel.

Reference is now made to FIG. 31, which shows a cutout view of the main conduit 220, the water conduit 218, the air conduit 212, the secure feature 204, the monitor wheel 304, and the jet plate 117. The main conduit 220, as shown, is secured to the bottomfeed 208 by the secure feature 204. One hook of the secure feature 204 is wrapped around the water conduit 218. The other hook, not visible, is wrapped around a water conduit on the other side of the main conduit 220. As discussed earlier, each hook could also be wrapped around the air conduit 212 or various other members of the main conduit 220, or the main conduit 220 itself.

Also shown in FIG. 31 is the monitor wheel 304 of the flow control 300. The rim of the monitor wheel 304 is exposed on the outer face of the jet panel 117. Alternatively, it may be hidden beneath the jet panel and require the jet panel to be removed to be accessed. Other locations of the monitor wheel 304 are also possible.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A bathing system comprising:

a shell molded to define a containment for containing water;

a hollow molded in the shell extending upward from a base of the hollow;

at least one fluid connector located near or at the base of the hollow and associated with a fluid supply system to supply fluid to the connector;

a removable jet panel with a jet plate and at least one jet on the jet plate, the jet plate dimensioned and constructed to fit over the hollow and constructed such that when the removable jet panel is in an installed position in the hollow, the jet is disposed to inject fluid into the containment;

the removable jet panel having at least one fluid port with fluid communication between the fluid port and at least one jet on the removable jet panel;

the fluid port and the fluid connector disposed such that the fluid port and the fluid connector are connected when the removable jet panel is in the installed position to provide a fluid supply from the fluid supply, through the fluid connector and fluid port, to the jet.

2. The bathing system as in claim 1 wherein the fluid port and the fluid connector are connected by a reversibly removable connection.

3. The bathing system as in claim 1, further comprising one or more mechanical aids to connect the fluid port and the fluid connector.

4. The bathing system as in claim 2, further comprising one or more mechanical aids to connect the fluid port and the fluid connector.

5. The bathing system as in claim 1 having two fluid ports which are an air fluid port, and a water fluid port, which respectively connect to an air fluid connector with an air supply and a water fluid connector with a water supply.

6. The bathing system as in claim 1 wherein the fluid port and the fluid connector are partitioned into separate conduits for separately supplying air and water from air and water supplies through the separate conduits in the fluid connector and port, to supply air and water to the jet.

7. The bathing system as in claim 1 additionally comprising a flow control to regulate the flow of fluid to the jet.

8. The bathing system as in claim 7 wherein the flow control is disposed at or near the fluid port.

9. The bathing system as in claim 8 wherein the flow control includes a manually operated monitor wheel, which when turned causes a flow control valve to open and close.

10. The bathing system as in claim 4 wherein the mechanical aids include hooks that interlock with fluid conduits.

11. A removable jet system comprising:

a base;

at least one fluid connector located near or at the base and associated with a fluid supply system to supply fluid to the connector;

a removable jet panel with a jet plate and at least one jet on the jet plate, the jet panel constructed such that when the removable jet panel is in an installed position, the jet is disposed to release fluid;

the removable jet panel having a fluid port with fluid communication between the fluid port and the jet on the removable jet panel;

the fluid port and the fluid connector disposed such that the fluid port and the fluid connector are connected when the removable jet panel is in the installed position to provide a fluid supply from the fluid supply, through the fluid connector and port, to the jet.

12. A removable jet panel system for injecting fluid into a bathing system comprising:

a removable jet panel with a jet plate and at least one jet on the jet plate, the jet panel constructed with a fluid port at or near its base, with fluid communication between the fluid port and the jet on the removable jet panel;

the fluid port constructed for reversible connection with a fluid connector having a fluid supply.

* * * * *